US006106094A

United States Patent [19]

Otani et al.

[11] Patent Number: 6,106,094

[45] Date of Patent: Aug. 22, 2000

[54] PRINTER APPARATUS AND PRINTED MATTER INSPECTING APPARATUS

[75] Inventors: Taizo Otani, Tokyo; Tsutomu Yoneda, 2-4-102, Hakusan 1-chome, Asao-ku, 215 Kanagawa, both of Japan

[73] Assignees: Neopt Corporation; Nit Leasing Co., Ltd., both of Tokyo; Tsutomu Yoneda, Kawasaki, all of Japan

[21] Appl. No.: 08/790,413

[22] Filed: Jan. 30, 1997

[30] Foreign Application Priority Data

Jan. 30, 1996 [JP] Japan ..... 8-014661
Apr. 12, 1996 [JP] Japan ..... 8-091327

[51] Int. Cl.[7] ..... B41J 29/393

[52] U.S. Cl. ..... 347/19

[58] Field of Search ..... 347/19, 188, 10, 347/14

[56] References Cited

U.S. PATENT DOCUMENTS 4,328,504 5/1982 Weber et al. ..... 347/19
4,422,098 12/1983 Logie et al. ..... 358/406
4,977,459 12/1990 Ebinuma et al. ..... 347/19
5,164,747 11/1992 Osada et al. ..... 347/19
5,539,434 7/1996 Fuse ..... 347/188

FOREIGN PATENT DOCUMENTS 5-16498 1/1993 Japan .
8-20117 1/1996 Japan .

*Primary Examiner*—John Barlow
*Assistant Examiner*—Charles W. Stewart, Jr.
*Attorney, Agent, or Firm*—Jacobson, Price, Holman & Stern, PLLC

[57] ABSTRACT

A printer apparatus for successively printing input data at a high speed having an input unit for inputting printing information to be printed on a print medium; a printing unit for printing a predetermined image on the print medium based on the input printing information; an image sensor unit for reading the printed image on the print medium; and an inspecting unit for inspecting the state of printing by the printing unit by comparing the input image and the image read from the top of the print medium. Further, a printed matter inspecting apparatus having an image sensor unit for reading the image printed on the print medium; an input unit for inputting printing information to be printed on the print medium; and an inspecting unit for inspecting the state of the printing on the print medium by comparing the image read from the print medium and the input printing information.

17 Claims, 27 Drawing Sheets

PRINTER APPARATUS AND PRINTED MATTER INSPECTING APPARATUS

BACKGROUND OF THE INVENTION

1. Field of the Invention

The present invention relates to a printer apparatus for successively printing respectively different data on printing paper at a high speed and to a printed matter inspecting apparatus for inspecting printed matter on which different data have been successively printed by the printer apparatus.

2. Description of the Related Art

Among the methods for recording desired information on paper or another medium so that it can be visually recognized, there have been known the method of recording the same information on a large amount of media by a printing machine at a high speed, the method of printing respectively different data on a relatively small number of media by a printer used as terminal equipment of a computer, though the printing speed is low, etc.

However, there has also been a strong desire to print a large amount of variable data, that is, data different for every sheet of paper, at a high speed. Therefore, a high speed printer apparatus using for example ink jet heads to print on printing paper which moves at a speed of 5 meters per second, in other words, to print at a speed of at least 15 sheets per second assuming the paper has an A4 size having a side length of about 30 cm or a letter size, is also being commercialized.

Such a printer apparatus is sometimes used for the printing of documents which have to be printed in huge numbers but which also require different numbering or details, for example, stock certificates and other negotiable securities, various types of monetary certificates, or large numbers of bills to be sent to large numbers of customers. When printing such important documents, it is necessary to prevent all mistakes such as duplication or skipping of printed content etc. In addition, even blurring, batter, or other printing defects and variation in line widths or darkness and other low quality printing cannot be allowed. High quality printing of the correct data is required.

In for example a high speed printer apparatus using the ink jet system mentioned above, however, ink spots, blank white areas, and other printing defects called "streakers" are apt to occur. Even in the conventional relatively low speed printer apparatuses of the electrophotographic system, when performing a large amount of printing, unevenness occurs or noise is caused at a considerably high frequency.

In order to prevent such printing defects, it is necessary to keep the printing heads constantly in a good condition. Further, in order to prevent defective printed matter from leaving the premises, it is necessary to inspect the results of the printing by some method or another.

However, it is impossible to visually inspect printed matters printed at a speed of more than 10 sheets per second in real time. Even if the speed is low, a large number of workers and enormous time become necessary for manually inspecting the enormous amount of printed matter. It is also difficult for human workers to visually successively inspect printed matter which is produced. For this reason, there is the disadvantage that it is not possible to fully inspect the printed matter and not possible to completely eliminate the possibility of defective printed matter from being shipped out.

SUMMARY OF THE INVENTION

An object of the present invention is to provide a printer apparatus having a high reliability which enables precise inspection of the results of printing for individual printed matter and thereby eliminates defective printed matter and enables correct and high quality printing to be carried out at a high speed.

Another object of the present invention is to provide a printer apparatus which can suitably grasp the state of the heads and can adjust them to the desirable condition.

Further another object of the present invention is to provide a printed matter inspecting apparatus which can inspect the printed matter produced by a printer apparatus which prints variable data.

So as to achieve the objects, the present invention provides a printer apparatus provided with an input means for inputting printing information to be printed on a print medium; a printing means for printing a predetermined image on the print medium based on the input printing information; an image sensor means for reading the printed image on the print medium; and an inspecting means for comparing the input image and the image read from the print medium to inspect the state of printing by that printing means.

Further, so as to achieve the objects, the present invention provides a printer apparatus wherein a test pattern generating means for generating a predetermined test pattern is further provided; the printing means prints the image data based on the input printing information or the generated test pattern on the print medium; the image sensor means reads the printed test pattern on the print medium as the image data; and the inspecting means compares the generated test pattern and the test pattern which was read as the image data to inspect the state of printing by that printing means.

Further, so as to achieve the objects, the present invention provides a printed matter inspecting apparatus provided with an image sensor means for reading an image printed on a print medium; an input means for inputting printing information to be printed on the print medium; and an inspecting means for comparing the image read from the print medium and the input printing information to inspect the state of printing on the printing medium.

BRIEF DESCRIPTION OF THE DRAWINGS

These and other objects and features of the present invention will become clearer from the following description of the preferred embodiments given with reference to the attached drawings, in which.

DESCRIPTION OF THE PREFERRED EMBODIMENTS

First Embodiment

A first embodiment of the present invention will be explained by referring to FIG. 1A to FIG. 14.

The apparatus explained as the first embodiment is a large scale printing system which prints printing data input by a host computer at a high speed using a plurality of ink jet heads, in particular one which inspects the printed results and can detect the printed contents and defects in the printing quality.

Figure 1A:
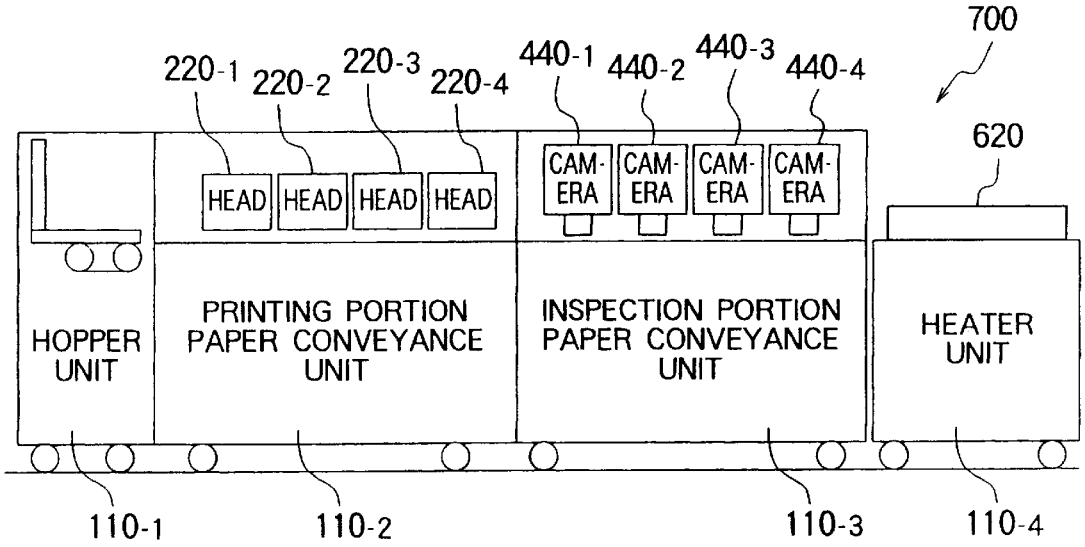
FIGS. 1A to 1D are views of the outer appearance of a printer apparatus according to a first embodiment of the present invention.
Figure 1B:
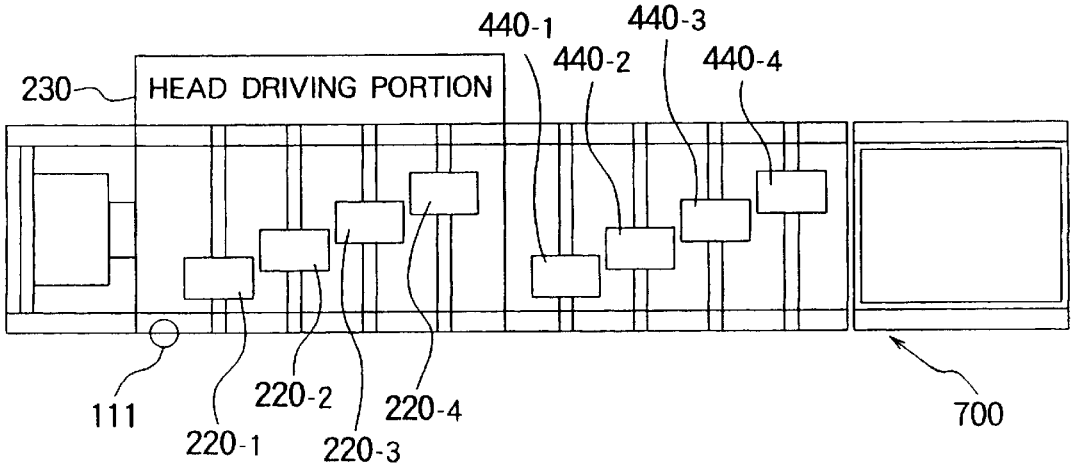
Figure 1C:
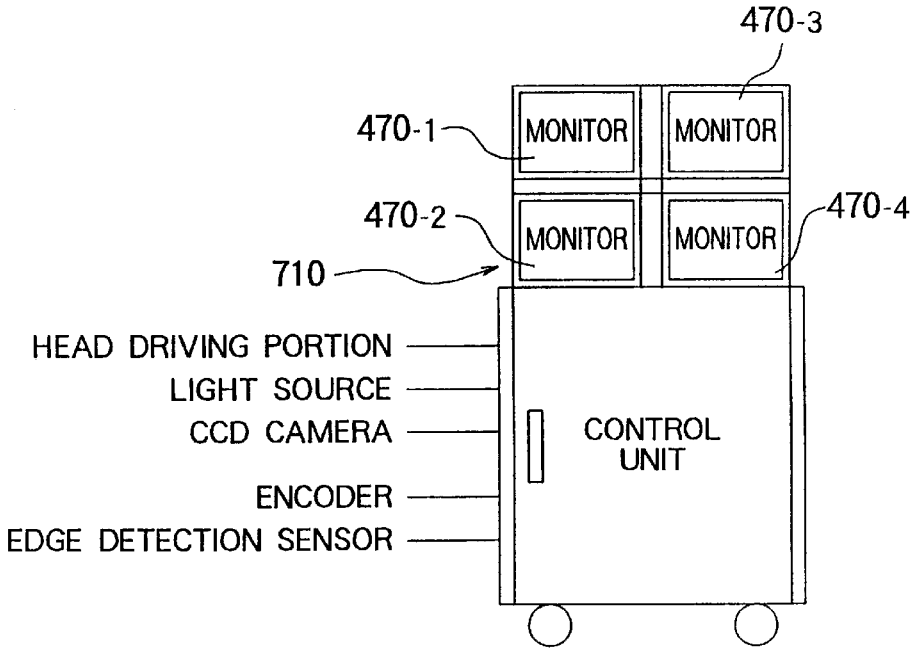
Figure 1D:
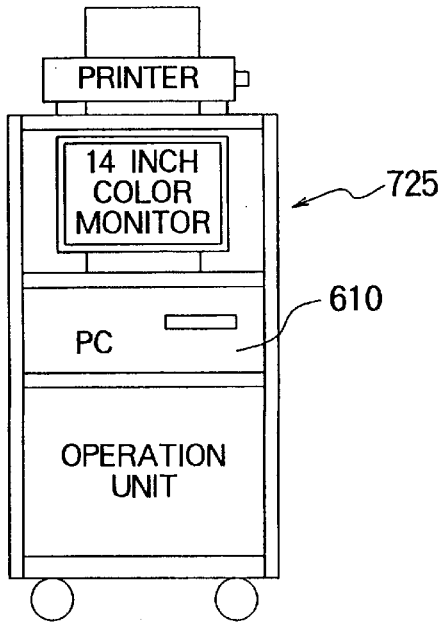

FIG. 1A to FIG. 1D are schematic views of the outer appearance of a printer apparatus 100*a* of this system, in which FIG. 1A is a side view of a main unit 700; FIG. 1B is a top view of the main unit 700; FIG. 1C is a view of a control unit 710; and FIG. 1D is a view of an operation unit 725.

As shown in FIG. 1A to FIG. 1D, the printer apparatus 100*a* is constituted by a main unit 700 in which the printing paper is actually conveyed, the printing is carried out, and the printing result is inspected, a control unit 710 accommodated in a different housing from that of the main unit 700, and an operation unit 725 similarly accommodated in a different housing.

Figure 2:
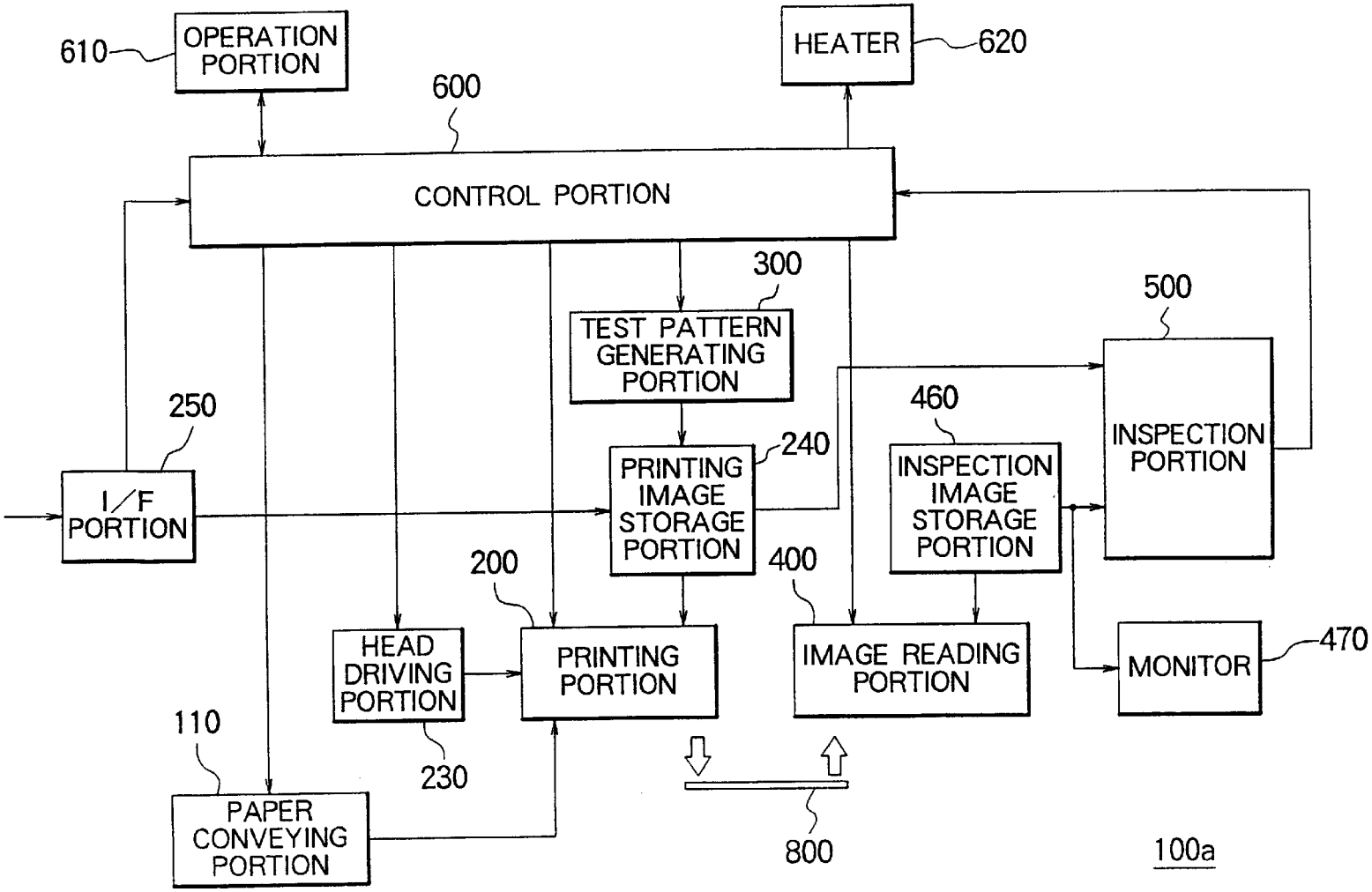
FIG. 2 is a view of the configuration of the printer apparatus.

FIG. 2 is a block diagram of the configuration of the printer apparatus 100*a*.

The printer apparatus 100*a* has a paper conveying portion 110, a printing portion 200, a head driving portion 20, a printing image storage portion 240, an interface portion 250, a test pattern generating portion 300, an image reading portion 400, an inspection image storage portion 460, a monitor 470, an inspecting portion 500, a control portion 600, an operation portion 610, and a heater 620.

First, an explanation will be made of the configurations of the different portions of the printer apparatus of the first embodiment based on FIG. 1A to FIG. 1D and FIG. 2.

The paper conveying portion 110 is a paper feed mechanism which successively conveys the printing paper of the print medium. As shown in FIG. 1A, the paper conveying portion 110 is constituted by an integrally connected assembly of a hopper unit $\mathbf{110}_{-1}$ which successively sends the cut paper from a hopper, a printing portion paper conveying unit $\mathbf{110}_{-2}$ which conveys the printing paper beneath the printing heads $\mathbf{220}_{-1}$ to $\mathbf{220}_{-4}$, an inspecting portion paper conveying unit $\mathbf{110}_{-3}$ which conveys the printing paper beneath the CCD cameras $\mathbf{440}_{-1}$ to $\mathbf{440}_{-4}$, a heater portion paper conveying unit $\mathbf{110}_{-4}$ which conveys the sheets in the heater 620, and a not illustrated stacker unit for stacking the ejected printing paper. Due to this, the printing paper is stably conveyed in the main unit 700 at a high predetermined speed.

The paper conveying portion 110 is constituted by a roller and guide for feeding the printing paper, a sensor for detecting the position of the printing paper, an encoder for detecting the sheet conveyance speed from the rotation speed of the roller, etc. The conveyance and stoppage of the printing paper, the speed adjustment, etc. are carried out based on control signals input from the control portion 600. Further, a pulse from the encoder 111 provided in the paper feed roller near the start of the printing portion paper conveying unit $\mathbf{110}_{-2}$ is output to the printing portion 200 as a signal for generating the timing at the time of printing.

Note that the paper conveying portion 110 of the present embodiment conveys the printing paper at a speed of about 3 meters per second.

The printing portion 200 prints the image data stored in the printing image storage portion 240 on the printing paper based on a control signal input from the control portion 600.

A detailed explanation will be made of the printing portion 200 by referring to FIG. 3 to FIG. 6.

Figure 3:
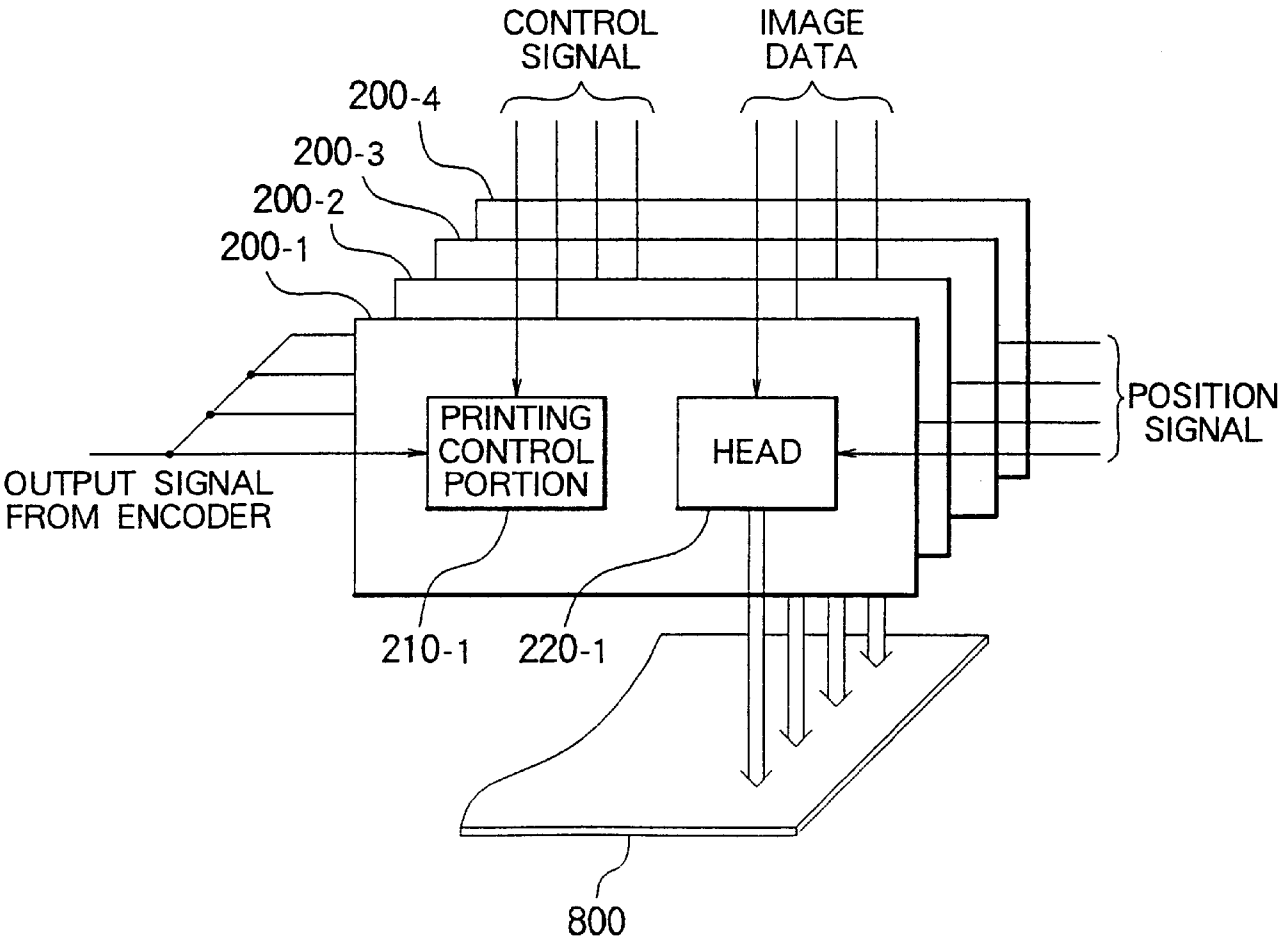
FIG. 3 is a view of the configuration of a printing portion of the printer apparatus shown in FIG. 2.

FIG. 3 is a block diagram of the configuration of the printing portion 200.

Figure 4A:
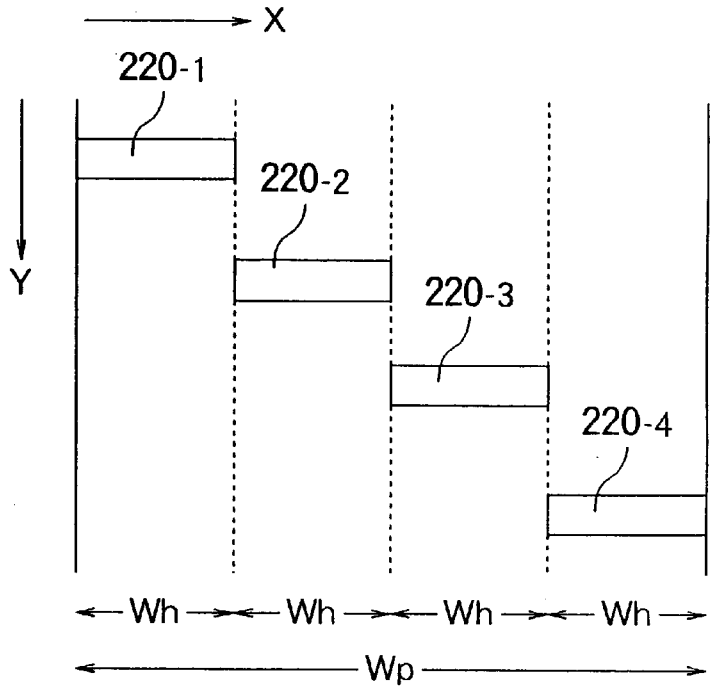
FIG. 4A is a view of the state of arrangement of the printing heads of the printer apparatus shown in FIG. 2.
Figure 4B:
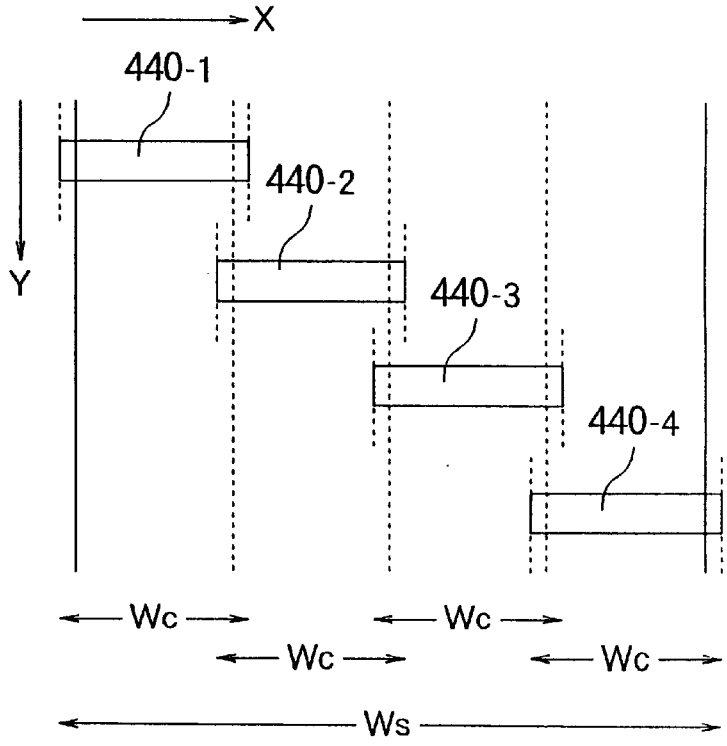
FIG. 4B is a view of the state of arrangement of charge-coupled device (CCD) cameras of the printer apparatus shown in FIG. 2.

FIG. 4A is a view of the arrangement of the heads $\mathbf{220}_{-1}$ to $\mathbf{220}_{-4}$ of the printing portion 200; and FIG. 4B is a view of the arrangement of the cameras $\mathbf{440}_{-1}$ to $\mathbf{440}_{-4}$ of the image reading portion 400 explained later.

The printing portion 200 has four printing portions $\mathbf{200}_{-1}$ to $\mathbf{200}_{-4}$. To each printing portion $\mathbf{200}_{-i}$ (i=1 to 4), a control signal is input from the control portion 600 whereby image data stored in the printing image storage portion 240 is read. Further, the signal from the encoder 111 of the paper conveying portion 110 mentioned above is commonly input to all of the printing portions $\mathbf{200}_{-1}$ to $\mathbf{200}_{-4}$.

Each printing portion $\mathbf{200}_{-i}$ (i=1 to 4) has a printing control portion $\mathbf{210}_{-i}$ and a head $\mathbf{220}_{-i}$.

The printing control portion 210 controls the operation timing of the heads 220 with respect to the printing paper being conveyed and the ink dropping speed mentioned later in the heads 220 based on control signal input from the control portion 600 and the signal input from the encoder 111 of the paper conveying portion 110.

The heads 220 are ink jet heads each having a dot density of 240 dpi and a printing width Wh of 4 inches. They successively record the image data read from the printing image storage portion 240 under the control of the printing control portion 210.

In the present embodiment, the four heads 2201 to $\mathbf{220}_{-4}$ are arranged so that the printing dots of the heads run into each other as shown in FIG. 4A. Data can therefore be printed on the printing paper with a printing width Wp of 16 inches (4 inches×4) as a whole.

An explanation will next be made of the printing system of the heads 220 referring to FIG. 5.

Figure 5:
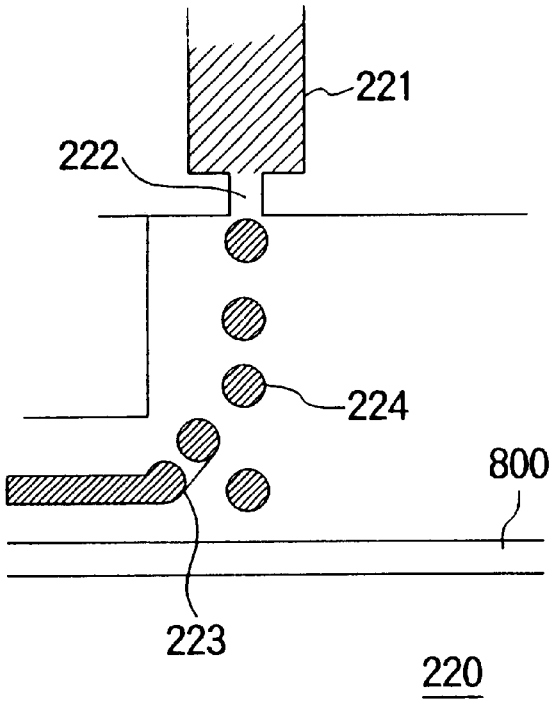
FIG. 5 is a view for explaining the configuration and the principle of operation of the printing heads of the printer apparatus shown in FIG. 2.

FIG. 5 is a view of the configuration and principle of operation of a head 220.

In the head 220, the ink 224 in an ink bottle 221 is dropped from a nozzle 222 corresponding to a dot in a cycle of 100 kHz, that is, 100,000 droplets of ink are dropped per second. When the position of the printing paper 800 conveyed under the nozzle 222 is a position at which the paper should be printed black by the ink 224, the ink 224 is dropped onto the printing paper 800 as it is, thereby to make the position of the printing paper 800 black. Further, where the position is a blank position which is not supposed to be printed, an electric field is applied by a not illustrated electric field applying means so as to cause the ink 224 to be attracted to a catcher 223 side. As a result, the ink 224 is collected in the catcher 223 and is not dropped onto the printing paper 800.

Figure 6:
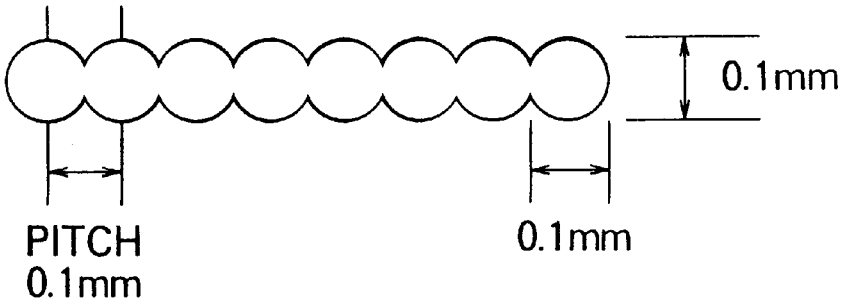
FIG. 6 is a view of a state of printing by the printing heads shown in FIG. 5.

By this method, the heads 220 appropriately print dots having a dot pitch of about 0.1 mm and a dot size of about 0.1 mm diameter as shown in FIG. 6 and thereby print a desired image.

Note that it is also possible to have a head 220 drop a plurality of drops of ink 224 at the same position. This enables the printer apparatus 100*a* to express pseudo gradation.

In the present embodiment, 240 dpi/4 inch ink jet heads are used.

The head driving portion 230 is a means for performing fine adjustment of the position of the heads 220 of the printing portion 200 mentioned above. In the present embodiment, since one piece of printed matter is printed by using four heads $\mathbf{220}_{-1}$ to $\mathbf{220}_{-4}$, when they deviate in position, the positions of dots printed also deviate and it becomes impossible to perform adequate printing. For this reason, it is necessary to adjust the position of the head driving portion 230 with a precision of the same level as that of the resolution of the printer apparatus 100*a*. The head driving portion 230 performs this adjustment of position.

Accordingly, the head driving portion 230 is constituted by four head driving portions $\mathbf{230}_{-1}$ to $\mathbf{230}_{-4}$ corresponding to the four heads $\mathbf{220}_{-1}$ to $\mathbf{220}_{-4}$.

The head driving portions $\mathbf{230}_{-i}$ (i=1 to 4) are each constituted by step motors for moving the positions of the heads $\mathbf{220}_{-1}$ to $\mathbf{220}_{-4}$ and a limit switch for limiting the range of movement thereof etc. They adjust the positions of the heads $\mathbf{220}_{-1}$ to $\mathbf{220}_{-4}$ within the range of movement which was set in advance based on a control signal input from the control portion 600.

Note that the control portion 600 generates a signal for the adjustment of the position of each head $\mathbf{220}_{-i}$ (i=1 to 4) based on the result of inspection of the printing result in the inspecting portion 500 explained later.

Further the heads 220 are adjusted in both of the main scanning direction, that is, the direction of the printing heads (X-direction in FIG. 4A), and the sub-scanning direction, which is equal to the direction of conveyance of the printing paper (Y-direction in FIG. 4A). However, for the adjustment in the Y-direction, the adjustment is performed so that the finally suitable printing can be carried out by adjusting both the position and the timing of printing of the heads 220.

The printing image storage portion 240 is a memory for storing the image data to be printed on the printing paper 800 by the printing portion 200. In the present embodiment, a dual port RAM is used.

In the printing image storage portion 240, image data transferred from the host computer via the interface portion 250 or image data generated at the test pattern generating portion 300 are stored in a bit map format.

The interface portion 250 is an interface which transfers the image data from a not illustrated host computer to the printing image storage portion 240. In the present embodiment, it is an exclusive serial interface. The printing image data is transferred by this interface portion 250 at a high speed in accordance with the speed of printing.

The test pattern generating portion 300 generates a test pattern for checking whether or not the portions of the printer apparatus 100*a* are operating normally and can suitably perform the printing. In the present embodiment, the image data used for the check is stored in a ROM of the test pattern generating portion 300 in advance. The image data is read based on control signals input from the control portion 600, developed into a bit map image, and output to the printing image storage portion 240.

Note that before a series of printing operations is carried out, such as when the printer apparatus 100*a* is started up, the control portion 600 makes the test pattern generating portion 300 generate a test pattern and perform a test printing to check the state of printing of the printer apparatus 100*a*.

In the present embodiment, as the test pattern, a first test pattern for the adjustment of the position of the four heads $\mathbf{220}_{-1}$ to $\mathbf{220}_{-4}$, a second test pattern for evaluating the condition of the printing heads, and a third test pattern for evaluating the quality of the printed letters, i.e., three test patterns, are used.

Figure 7A:
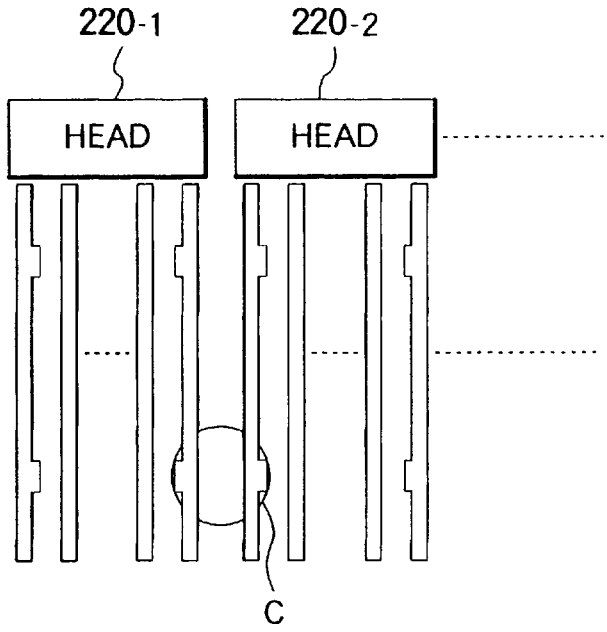
FIG. 7A is a view of part of a first test pattern generated by a test pattern generating portion of the printer apparatus shown in FIG. 2.
Figure 7B:
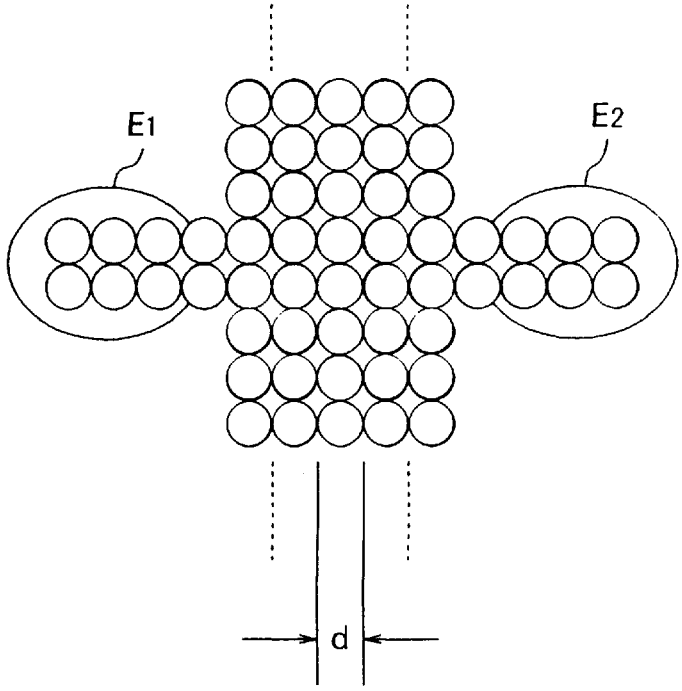
FIG. 7B is an enlarged view of a region C of FIG. 7A.

A part of the first test pattern for the adjustment of the position of the heads $\mathbf{220}_{-i}$ (i=1 to 4) is shown in FIG. 7A and FIG. 7B.

FIG. 7A is a view of a part of the test pattern; and FIG. 7B is an enlarged view of the region C of FIG. 7A.

By printing a pattern such as shown in FIG. 7A and FIG. 7B giving a gap of one dot between the two heads $\mathbf{220}_{-i}$ and $\mathbf{220}_{-i-1}$ (i=1 to 3) and checking whether or not the gap d is one dot in size on the printed image as well, it is possible to detect any deviation of position between the two heads in the X-direction (main scanning direction) and becomes possible to correct the same.

Further, by checking whether or not the patterns printed in the X-direction as indicated by the test patterns E1 and E2 of FIG. 7B are printed on the same row, it is possible to detect any deviation of the printing positions of the two heads $\mathbf{220}_{-i}$ and $\mathbf{220}_{-i-1}$ in the Y-direction (sub-scanning direction) and becomes possible to correct the same.

Figure 8:
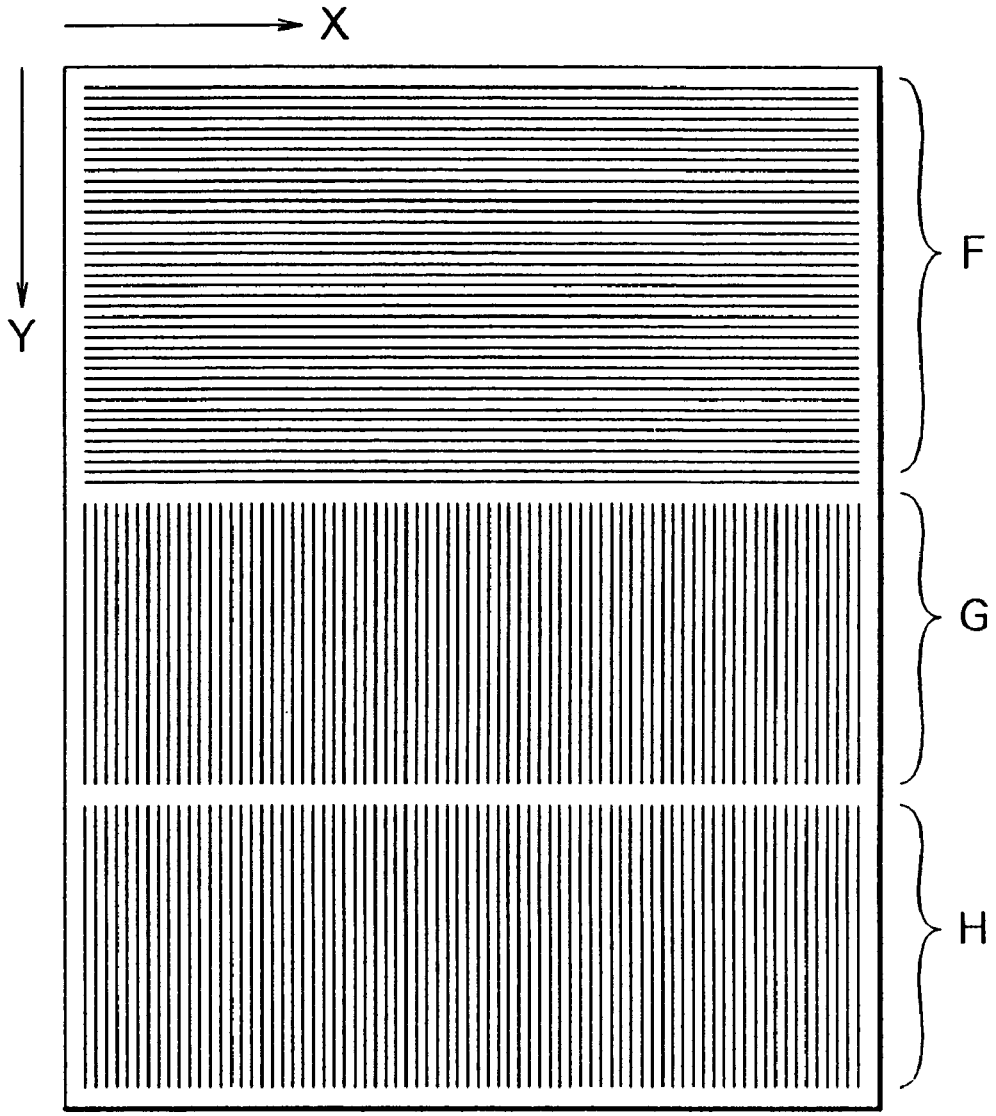
FIG. 8 is a view of a second test pattern generated by the test pattern generating portion of the printer apparatus shown in FIG. 2.

The second test pattern for inspecting the condition of the printing heads is shown in FIG. 8.

The second test pattern shown in FIG. 8 is comprised by the three test patterns F, G, and H.

The test pattern F is a pattern obtained by drawing straight lines in the X-direction for all of the dots in the Y-direction, that is, a pattern obtained by alternately printing all dots of the heads black and white.

The test pattern G is a pattern obtained by alternately printing all dots in the X-direction black and white so as to draw straight lines in the Y-direction.

The test pattern H is a pattern obtained by inverting the black or white dots of the test pattern G.

By using such a second test pattern, for example, it becomes possible to inspect the function of the heads 220 for every dot. For example, any clogging of the nozzles, leakage of ink, or interference with other dots can be immediately detected.

The third test pattern, while not shown, is a test pattern comprised of a large number of different letters. This third test pattern is used to check on the quality of the printing of letters and figures with particular meanings. More specifically, it is used to check for misalignment of letters, thinning of letters, thickening of letters, errors in printing position, streakers, pinholes, skews in letters, stains, differences in darkness, missing letters, etc.

The image reading portion 400 reads the image printed on the printing paper by the printing portion 200 and outputs the same as a bit map image data to the inspection image storage portion 460 for checking the printing content and printing quality.

A detailed explanation will be made next of the image reading portion 400 referring to FIG. 9 to FIG. 12.

Figure 9:
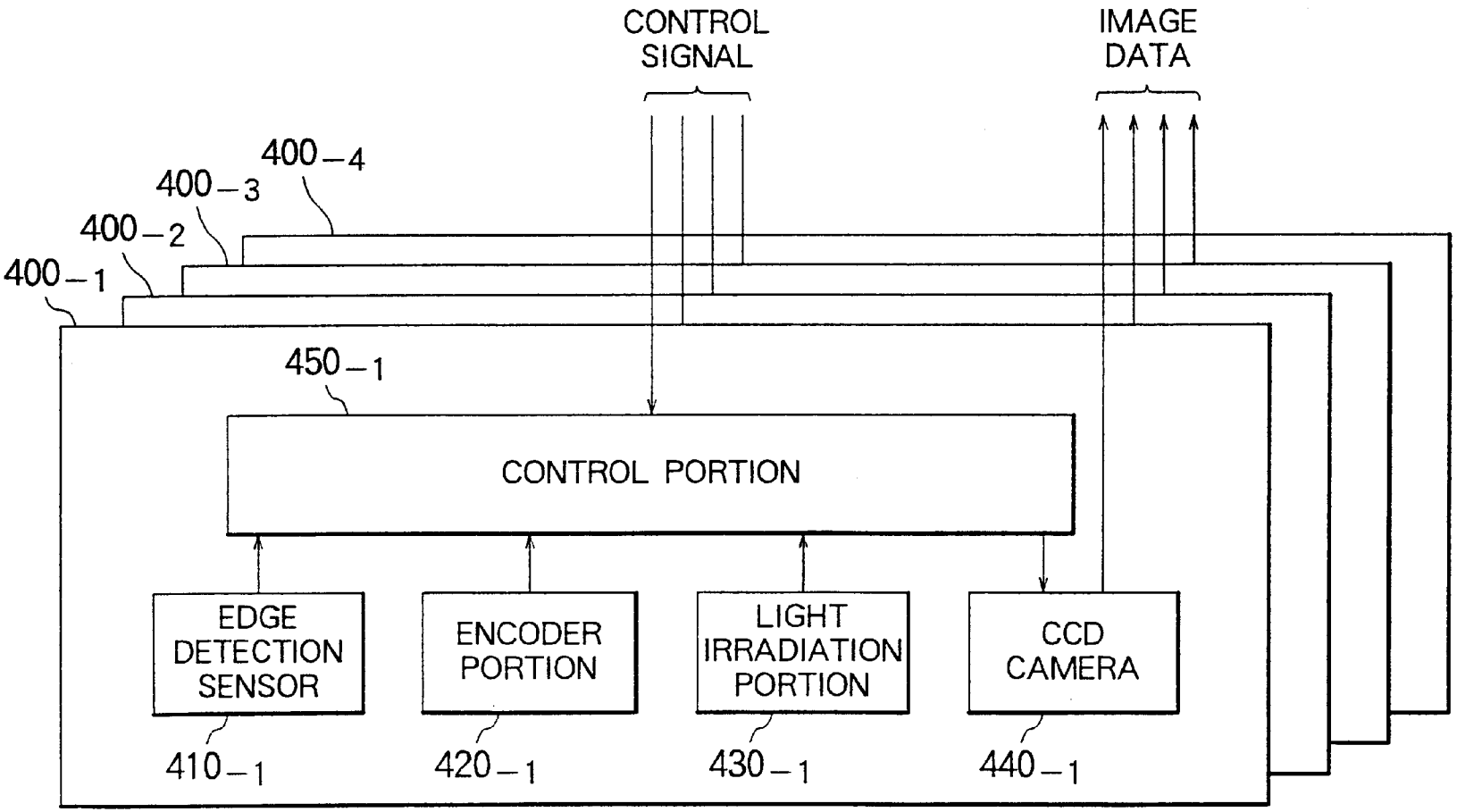
FIG. 9 is a view of the configuration of an image reading portion of the printer apparatus shown in FIG. 2.

FIG. 9 is a block diagram of the configuration of the image reading portion 400.

The image reading portion 400 is configured by four image reading portions $\mathbf{400}_{-1}$ to $\mathbf{400}_{-4}$. A control signal from the control portion 600 to each image reading portion $\mathbf{400}_{-i}$ (i=1 to 4). Further, the read image data is output from each image reading portion $\mathbf{400}_{-i}$ to the inspection image storage portion 460.

Each image reading portion $\mathbf{400}_{-i}$ (i=1 to 4) has an edge detection sensor $\mathbf{410}_{-i}$, an encoder portion $\mathbf{420}_{-i}$, a light irradiation portion $\mathbf{430}_{-i}$, a CCD camera $\mathbf{440}_{-i}$, and a control portion $\mathbf{450}_{-i}$.

The edge detection sensor 410 is provided in the vicinity of the CCD camera 440 of each image reading portion 400 and detects the edge of the printing paper 800 which has finished being print by the printing portion 200 and which is conveyed onward. When detecting the edge, a signal to that effect is output to the control portion 450.

The encoder portion 420 is similarly provided in the vicinity of the CCD camera 440 of the image reading portion 400 and detects the speed of conveyance of the printing paper 800 detected at the edge detection sensor 410.

Figure 10:
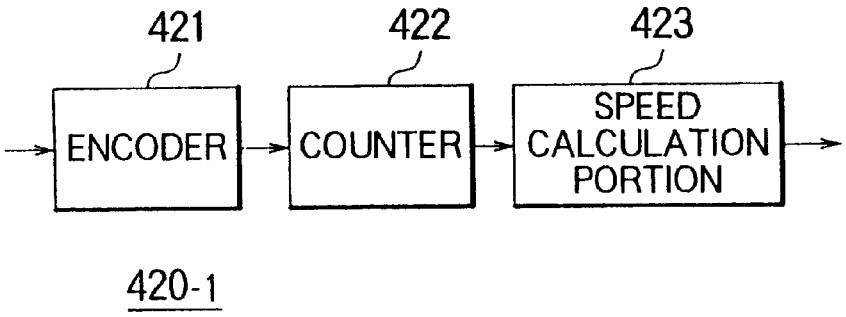
FIG. 10 is a view of the configuration of an encoder portion of the image reading portion shown in FIG. 9.

An explanation will be made next of the configuration of the encoder portion 420 referring to FIG. 10.

The encoder portion 420 has an encoder 421, a counter 422, and a speed calculation portion 423.

The encoder 421 rotates integrally with the printing paper conveyance roller of for example the paper conveying portion 110 and outputs a predetermined pulse corresponding to the rotation angle. The pulse is counted by the counter 422, and the speed of conveyance of the printing paper 800 is calculated at the speed calculation portion 423 based on the value counted within a predetermined time.

The light irradiation portion 430 is a means for giving a suitable amount of light to the region on the printing paper for the CCD camera 440 mentioned later to fetch the image. In the present embodiment, light of a halogen lamp provided in the housing is guided by an optical fiber cable and irradiated to the range of the CCD camera 440.

When the CCD camera 440 fetches an image, the faster the speed of conveyance of the printing paper 800, the larger the amount of light which is required. Namely, the speed of conveyance of the printing paper 800 and the amount of light which is required have an almost proportional relationship. Accordingly, the amount of light irradiated by the light irradiation portion 430 is controlled based on the speed of conveyance of the printing paper detected by the encoder 421.

The CCD camera 440 reads the printed image and outputs the same to the inspection image storage portion 460.

An explanation will be made next of the configuration of the CCD camera 440 referring to FIG. 11 and FIG. 12.

Figure 11:
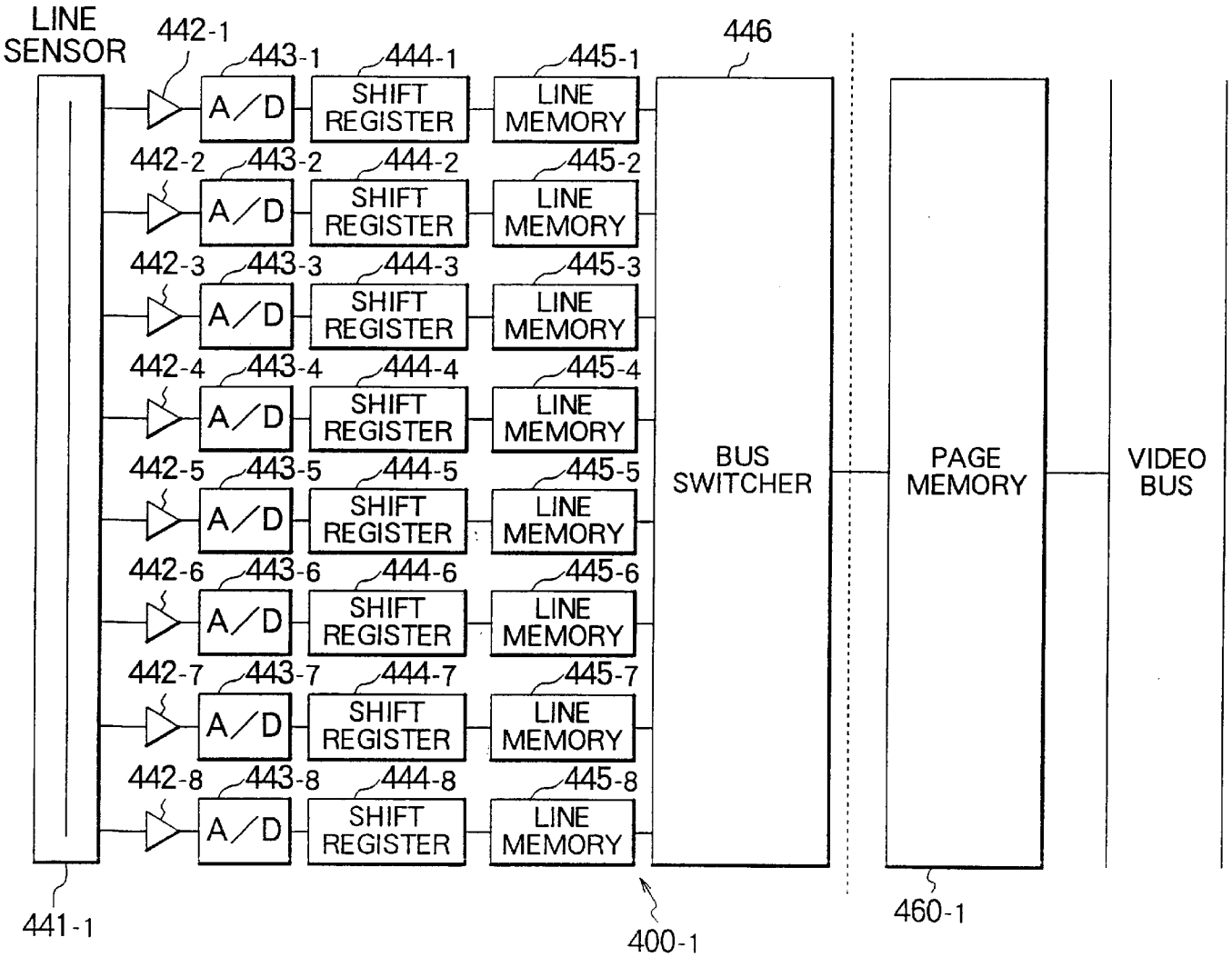
FIG. 11 is a view of the configuration of a CCD camera of the image reading portion shown in FIG. 9.
Figure 12:
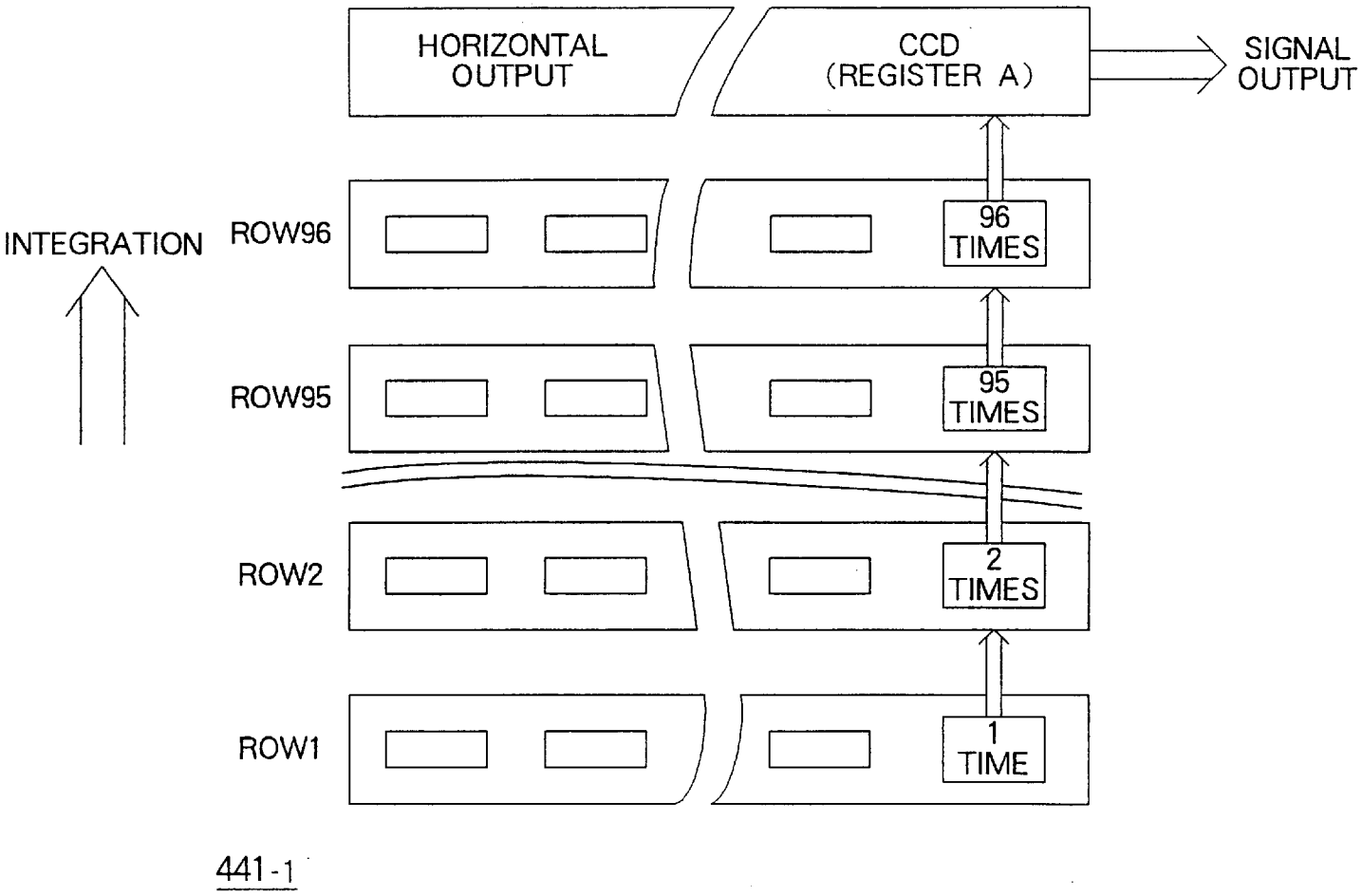
FIG. 12 is a view for explaining the configuration and operation of a TDI (time delay integration)-CCD sensor used as a line sensor in the CCD camera shown in FIG. 11.

FIG. 11 is a block diagram of the configuration of a CCD camera 440 and an inspection image storage portion 460; and FIG. 12 is a view further explaining the operation of the line sensor 441.

The CCD camera 440 has a line sensor 441, an output amplifier 442, an A/D converter 443, a shift register 444, a line memory 445, and a bus switcher 446.

The line sensor 441 is a TDI-CCD sensor having a resolution of 16 dots/mm, having 2048 elements in the horizontal direction, and having 96 steps of TDI in the vertical direction.

Accordingly, the reading width Wc by one line sensor 441 becomes 128 mm. In the present embodiment, four line sensors $\mathbf{441}_{-1}$ to $\mathbf{441}_{-4}$ are arranged partially overlapped in the reading range thereof as shown in FIG. 4B. This enables the entire range of the printing width Wp of the heads 220 to be read.

Further, a clock of 15 MHz is supplied to the TDI-CCD sensor 441. Accordingly, the time for scanning one line becomes about 17 $\mu$s.

An explanation will be made next of the TDI-CCD sensor 441 referring to FIG. 12.

In the TDI-CCD sensor 441, the optical image detected by the elements of the first row (ROW1) is formed on the front surface of the array. The charges generated by the photons are collected in the potential wells during a storage time corresponding to the scanning of one line. Then, using the clock in the vertical direction (TDI step direction), the charges are vertically shifted to the next row (ROW2). In the next row, if an image the same as the previous image is formed, the charges generated in ROW2 are added to the charges from the previous row. This means that the sensitivity or exposure time becomes double.

Accordingly, by synchronizing the clocks in the vertical direction and TDI transfer direction with the movement of the image, the image is integrated by exactly the number of the TDI steps.

Since the TDI-CCD sensor 441 of the present embodiment has 96 TDI steps, the detected image is integrated 96 times. The integrated data is finally serially output from the horizontal directional shift register of the TDI-CCD sensor 441.

Further, the TDI-CCD sensor 441 has a horizontal resolution of 2048 bits. These bits are output from eight taps. Accordingly, 256 bits of data are output from one tap.

The data output from the taps of the TDI-CCD sensor 441 are successively amplified at output amplifiers $\mathbf{442}_{-1}$ to $\mathbf{442}_{-8}$, converted from an analog to digital form at A/D converters $\mathbf{443}_{-i}$ to $\mathbf{443}_{-8}$, and input to the shift registers $\mathbf{444}_{-1}$ to $\mathbf{444}_{-8}$. Further, 256 bits worth of data are stored in the line memories $\mathbf{445}_{-1}$ to $\mathbf{445}_{-8}$. Eight line memories $\mathbf{445}_{-1}$ to $\mathbf{445}_{-8}$ are successively selected by the bus switcher for input of every line of data to the page memory $\mathbf{460}_{-1}$.

The control portion 450 is a control means for controlling the portions of the image reading portion 400.

The control portion 450 controls the amount of light of the light irradiation portion 430 and controls the reading of the image to the CCD camera 440 based on control signals from the control portion 600, the information of edge detection from the edge detection sensor 410 as explained before, and the information of the printing paper conveyance speed from the encoder portion 420.

The inspection image storage portion 460 is a storage means for storing the image data read by the image reading portion 400. In the present embodiment, the inspection image storage portion 460 is constituted by four page memories $\mathbf{460}_{-1}$ to $\mathbf{460}_{-4}$ corresponding to the four CCD cameras $\mathbf{440}_{-1}$ to $\mathbf{440}_{-4}$ as shown in FIG. 11.

The monitor 470 is a display device which displays the image data read by the four CCD cameras $\mathbf{440}_{-1}$ to $\mathbf{440}_{-4}$ as they are and is constituted by four monitors $\mathbf{470}_{-1}$ to $\mathbf{470}_{-4}$ corresponding to the four CCD cameras $\mathbf{440}_{-1}$ to $\mathbf{440}_{-4}$. This monitor 470 is placed on the control unit 710 as shown in for example FIG. 1C and FIG. 1D. It is used for assisting the worker to visually obtain a rough grasp of the situation in a normal mode and is used for checking the printing result in an abnormal mode.

The inspection portion 500 compares the printing image stored in the printing image storage portion 240 and the inspection image stored in the inspection image storage portion 460 read from the printed matter, decides whether or not the state of printing is adequate, and outputs the result of its decision to the control portion 600.

In the present embodiment, the inspection portion 500 is realized by an operational processing means having a usual microprocessor.

Below, an explanation will be made of the operation of the inspection portion 500 referring to the flowchart of FIG. 13.

First, when the inspection is started (step SO), the image data which are read by the four CCD cameras $\mathbf{440}_{-1}$ to $\mathbf{440}_{-4}$ and stored in the four page memories $\mathbf{460}_{-1}$ to $\mathbf{460}_{-4}$ are mapped in one frame so that they can be handled as one set of image data (step S1).

Next, reference pixels common to the read image data and the printing image data recorded in the printing image recording portion 240 are determined so as to enable the correspondence of pixels to be established between the two images (step S2). For example, processing is performed for establishing the correspondence of the two sets of image data with the pixels of the top side of the detected edge of the read image data as a reference, detecting the center point of the black pixels of the two and determining the corresponding pixels by using that point as a reference, etc.

Next, where this inspection is an inspection for inspecting a specific operation and function of the printer apparatus 100*a* using a specific test pattern as shown in for example FIG. 7A (step S3), the test pattern is retrieved from the read image data stored in the inspection image storage portion 460 and the state of printing of that pattern is checked (step S4).

When the state of printing is adequate (step S5), the fact that the result of the inspection of the operation was good is output (step S12) and the inspection is ended (step S14).

Further, when the state of printing was inadequate at step S5, the fact that there is a problem in the operation and function (step S13) is output and the inspection is ended (step S14).

When this inspection is an inspection of the result of printing during a usual printing operation and is an inspection for the overall matching of the printing image at step S3, it is examined if the settings are for performing the matching by a compressed image or performing the matching by the original image (step S6). Where it is a mode in which the matching is to be carried out with a compressed image, compression is carried out at step S7. In this compression, for example, processing is performed for dividing the image into blocks of 2×2 or 3×3 pixels and changing the compressed pixel to "1" when the total value of the pixels of the block is more than a predetermined value. This enables the original image to be compressed to ¼ or ⅓.

Next, the matching is carried out. In the matching, the pixels of the read image data and the original printing image data are successively compared (step S8), and the number of the pixels which do not coincide are cumulatively added (step S9). Note that, this matching is simultaneously carried out for a plurality of pixels. For example, if the image data is binary data and the microprocessor is a 32-bit CPU, the matching is simultaneously carried out for 32 pixels.

When the number of the cumulative non-coinciding pixels becomes larger than a predetermined threshold value THL (step S10), it is decided that the image data read from the printed matter is different from the original printing image data, that is, that there is a problem in the printing content or printing quality. Then, a signal indicating that the printing result is defective (no good) is output (step S13) and the inspection is ended (step S14).

When the number of the cumulative non-coinciding pixels does not exceed the threshold value THL (step S10) and in that state the matching is ended for all pixels in the region covered by the matching (step S11), a signal indicating that the printing result is normal is output (step S12) and the inspection is ended (step S14).

By such an operation, the inspection portion 500 compares the image data stored in the printing image storage portion 240 and the inspection image storage portion 460.

The result of the inspection is output to the control portion 600.

The control portion 600 is a control portion for controlling the portions constituting the printer apparatus 100*a* to make them perform the desired operations.

The control portion 600 receives as input the printing conditions and control conditions from a higher host computer via an Ethernet I/F in the control portion 600. The control portion 600 sets the operating conditions of the paper conveying portion 110, printing portion 200, image reading portion 400, and a heater 620 mentioned later based on the input data and performs control so that the conveyance of the printing paper, the printing to the printing paper, and the reading of the printed image can be suitably carried out in synchronization.

Further, the control portion 600 performs the inspection of the operation of the printer apparatus 100*a* automatically or by the instruction of a worker preceding a series of printing operations. In certain cases, it controls the head driving portions 230 based on the results of the inspection so as to correct the position of the heads 220 of the printing portion 200.

Further, the control portion 600 controls the paper conveying portion 110, the printing portion 200, etc. so as to immediately stop the printing operation when a signal indicating a printing defect is input from the inspection portion 500 during the printing operation.

The operation portion 610 is an operation terminal for performing relatively easy operations such as the setting of the operating conditions and printing parameters for the printer apparatus 100*a* or informing the data notified from the printer apparatus 100*a* to the worker. In the present embodiment, use is made of a general purpose PC which is connected by an RS232C interface.

To the operation portion 610 is further output a log file of the results of inspection of the state of printing etc.

The heater 620 is provided at the last stage of the main unit 700 of the printer apparatus 100*a*. It blows hot air for drying the ink printed on the printing paper 800.

Next, an explanation will be made of the operation of the printer apparatus 100*a*.

First, before performing a series of printing operations, a worker instructs the printer apparatus 100*a* through the operation portion 610 to inspect the state of printing and printing quality etc. of the apparatus.

Based on the instruction from the worker, the control portion 600 instructs the test pattern generating portion 300 to generate a test pattern. The test pattern generating portion 300 first generates the first test pattern containing the test pattern as shown in FIG. 7A and outputs the same to the printing image storage portion 240. The printing portion 200 reads this test pattern from the printing image storage portion 240 and prints this on the printing paper 800.

The test pattern printed on the printing paper 800 is read by the image reading portion 400 and stored in the inspection image storage portion 460. Then, the inspection portion 500 checks the pattern to inspect whether or not the printing is adequate, that is, whether or not the positions of the heads 220 are correct, and outputs the results of the inspection to the control portion 600.

Where the result of the inspection is that the printing is inadequate, the control portion 600 controls the head driving portions 230 so as to correct the positions of the heads 220 to the suitable positions based on the data input from the inspection portion 500.

After this, the control portion 600 instructs the test pattern generating portion 300 to generate the second test pattern shown in FIG. 8. By this, the test pattern generating portion 300 generates the second test pattern for mainly inspecting the condition of the printing heads and outputs the same to the printing image storage portion 240. In the same way as the time of the first test pattern, this test pattern is printed on the printing paper 800 by the printing portion 200 and the printed image is read by the image reading portion 400 and stored in the inspection image storage portion 460. The inspection portion 500 performs template matching on the image data stored in the inspection image storage portion 460 using the data stored in the printing image storage portion 240 as the reference data and examines the number of the non-coinciding pixels of the two images.

Where the number of the non-coinciding pixels is larger than a predetermined threshold value THL, it decides that the printing quality is sub-standard and outputs a signal indicating this and the additional data of the result of the inspection to the control portion 600. The control portion 600 outputs the results to the operation portion 610 to inform the worker of the fact that the condition of the printing heads is inadequate.

Where the number of the non-coinciding pixels is less than the predetermined threshold value THL, the inspection portion 500 decides that the condition of the printing heads is normal and outputs a signal indicating this to the control portion 600.

The control portion 600 then informs the worker of this via the operation portion 610.

A similar inspection method is then used to inspect the printing quality by using the third test pattern mentioned above. The result of this inspection is also informed to the worker in the same way as at the time of inspection by the second test pattern.

The worker starts the actual printing operation after confirming that the printer apparatus 100*a* operates normally.

First, the worker sets the printing content, printing conditions, etc. via the operation portion 610 or the higher host computer. By this, the control portion 600 of the printer apparatus 100*a* sets the operating conditions of the paper conveying portion 110, the printing portion 200, the image reading portion 400, the heater 620, etc.

When the conditions finish being set etc. and the actual printing operation is started, the bit map image data to be successively printed is input via the interface portion 250 to the printer apparatus 100*a* and successively stored in the printing image storage portion 240. Then, the image data stored in the printing image storage portion 240 is read by the printing portion 200 and printed on the printing paper 800.

The image printed on the printing paper 800 is read by the image reading portion 400 and stored in the inspection image storage portion 460. The image data stored in the inspection image storage portion 460 is successively output to the monitor 470.

Then, the inspection portion 500 compares the image data stored in the inspection image storage portion 460 with the original image data stored in the printing image storage portion 240 and decides whether or not the two images coincide. When there is more than a predetermined number of different pixels in the two images, it decides that the two images do not coincide, that is, that the state of printing is not adequate for some reason, and inputs a signal indicating this to the control portion 600.

Then, the control portion 600 commands the suspension of processing to the paper conveying portion 110 and the printing portion 200 based on that signal so as to immediately stop the printing operation.

In this way, the printer apparatus 100*a* of the present embodiment can perform printing at a high speed of about 3 meters per second while inspecting the printing content and state of printing.

By this, trouble such as duplication or skipping of the printing content can be almost completely avoided, and even important documents can be printed with a high reliability.

Further, when printing defects occur, the printing process can be immediately suspended, so the amount of defective printed matter can be suppressed to the lowest limit.

Further, it is possible to comprehensively inspect the printing content and printing quality, for example, not only defects of the printing heads per se, but also dirt due to the state of conveyance of the printing paper or poor adjustment of the clearance between the printing paper and the printing heads and therefore possible to perform higher quality printing.

Note that the present invention is not limited to the embodiment explained above. Various modifications are possible.

For example, in the present embodiment, the result of the inspection by the inspection portion 500 was input to the control portion 600 and control signals from that control portion 600 were used for processing such as suspension of the printing operation at for example the paper conveying portion 110 and the printing portion 200. When the processing is centralized at the control portion 600, however, since the signals are transferred via the control portion 600, there are cases where a time lag may be caused and it is not possible to quickly stop the apparatus. In such a case, it is also possible to transmit the signals for directly stopping the processing to the related components such as the paper conveying portion 110 and heads 220 from the inspection portion 500 when a defect in printing is detected.

Further, in the present embodiment, in the inspection processing performed preceding the printing operation, the three first to third test patterns were used to inspect the state of connection of the printing heads, the condition of the printing heads, and the quality of the printed letters.

However, the test patterns are not limited to these test patterns. Any test patterns can be used. Further, it is also possible to print in a single test pattern patterns enabling all of the inspections mentioned above to be carried out and to thereby perform the inspection by a single printing of a test pattern.

Figure 13:
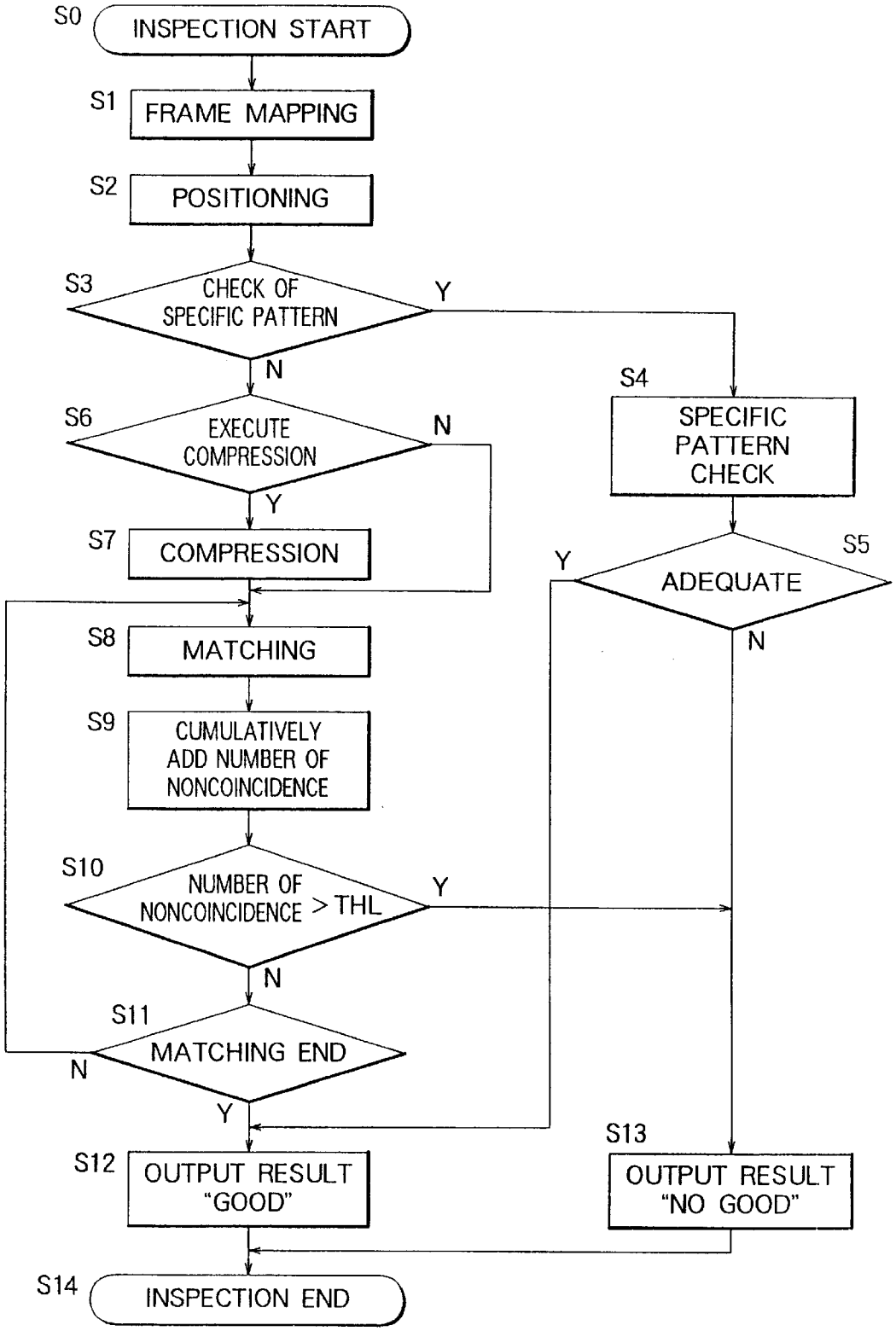
FIG. 13 is a flowchart for explaining the inspection operation performed in the inspecting portion of the printer apparatus shown in FIG. 2.

Further, the method of inspection by the inspection portion 500 is not limited to the procedure explained using the flowchart shown in FIG. 13.

Particularly, at step S3, the processing was carried out differentiating between the case of performing the inspection mainly by matching and inspection requiring fine analysis of the state of printing, but it is also possible for example to limit the range of inspection in the matching or to adopt other measures so as to enable these inspections to be performed by the same method. Such a method of inspection can also be adopted.

Further, the threshold value THL of the number of the non-coinciding pixels can be changed according to the object of the inspection. For example, it is also possible to perform a stricter inspection by making the threshold value THL smaller when inspecting the printer apparatus by using the test pattern, and possible to ease the inspection somewhat by making the threshold value THL larger at the time of normal operation. Further, it is also possible to change this threshold value THL in accordance with the printed matter.

Further, the present invention is not limited to a printer apparatus which performs printing in black and white like the printer apparatus of the present embodiment and can be also applied to a printer apparatus performing multi-value printing, multi-color printing, or full-color printing.

The other signal processing procedures, signal transfer routes, etc. can also be freely modified within the scope of the present invention.

Second Embodiment

A second embodiment of the present invention will be explained next referring to FIG. 14 to FIG. 17.

The apparatus explained as the second embodiment is also a large scale printing system which prints successively input printing data at a high speed by using a plurality of ink jet heads in the same way as in the first embodiment. The method up to the high speed printing of the printing data and inspection of the printed results and the configuration for this purpose are the same as those of the printer apparatus 100*a*. However, when a printing defect occurred, the printing processing was immediately stopped in the printer apparatus 100*a* of the first embodiment, but the printer apparatus of the second embodiment performs processing to identify the defectively produced printed matter and designate the printing and the printed matter as invalid so as to continuously perform the printing processing per se.

First, an explanation will be made of the configuration of this printer apparatus 100*b* of the second embodiment referring to FIG. 14 and FIG. 15.

Note that the same components as those of the first embodiment are given the same symbols or numerals and explanations thereof will be omitted.

Figure 14A:
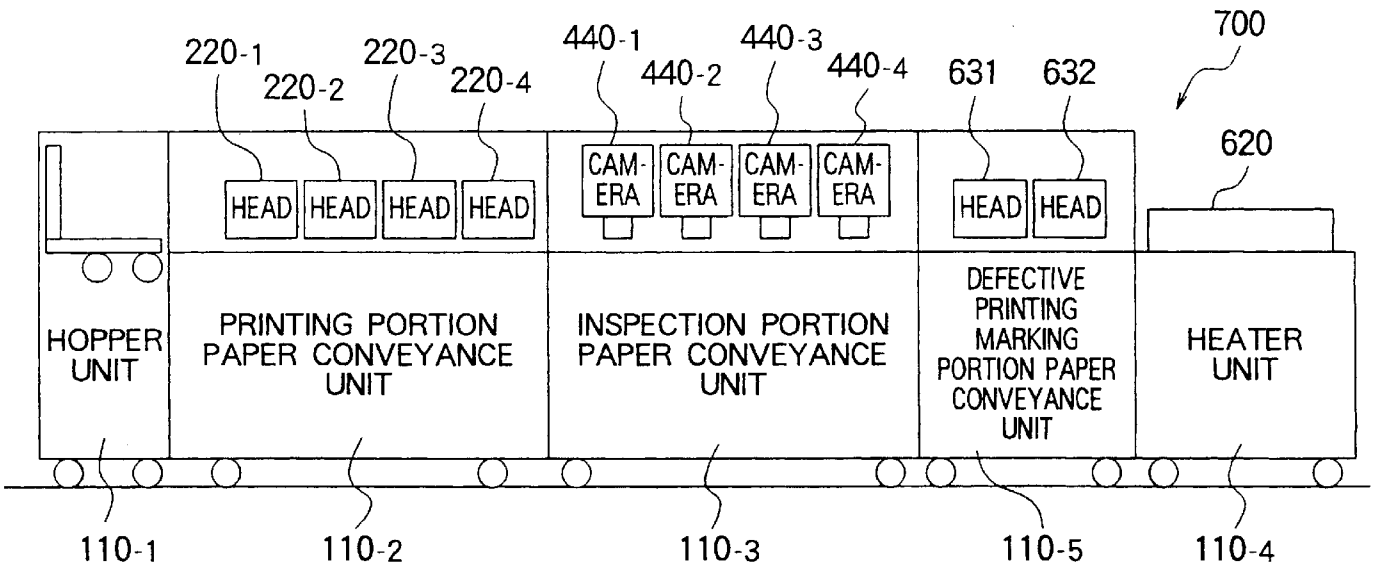
FIG. 14A and FIG. 14B are views of the outer appearance of the printer apparatus according to a second embodiment of the present invention.
Figure 14B:
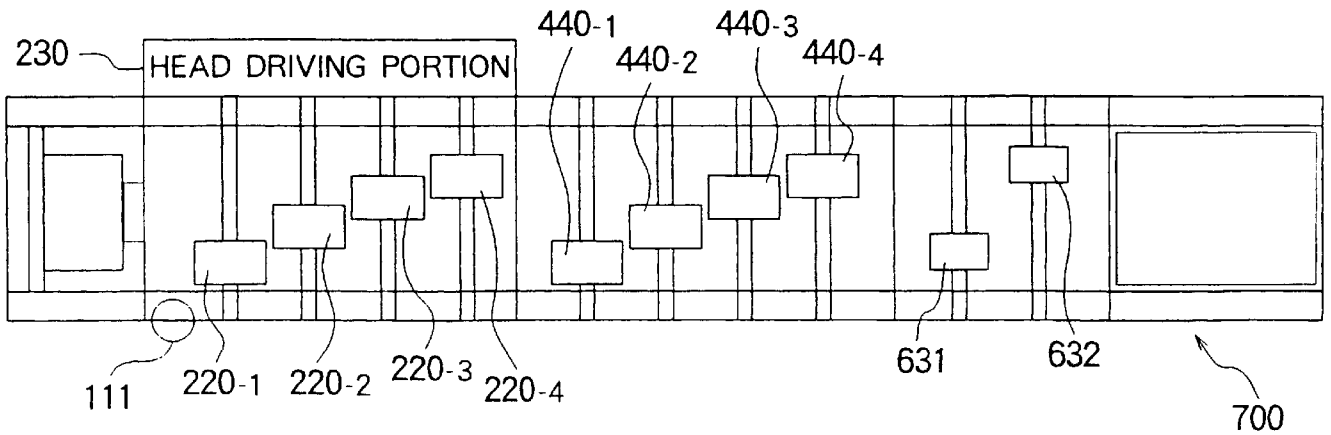

FIG. 14A and FIG. 14B are views of the outer appearance of the main components of the printer apparatus 100*b*, in which FIG. 14A is a side view and FIG. 14B is a top view.

As shown in FIG. 14A and FIG. 14B, in the printer apparatus 100*b* of the second embodiment, a defective printing marking portion 630 is newly provided between the unit of the CCD cameras 440 and the heater 620.

Figure 15:
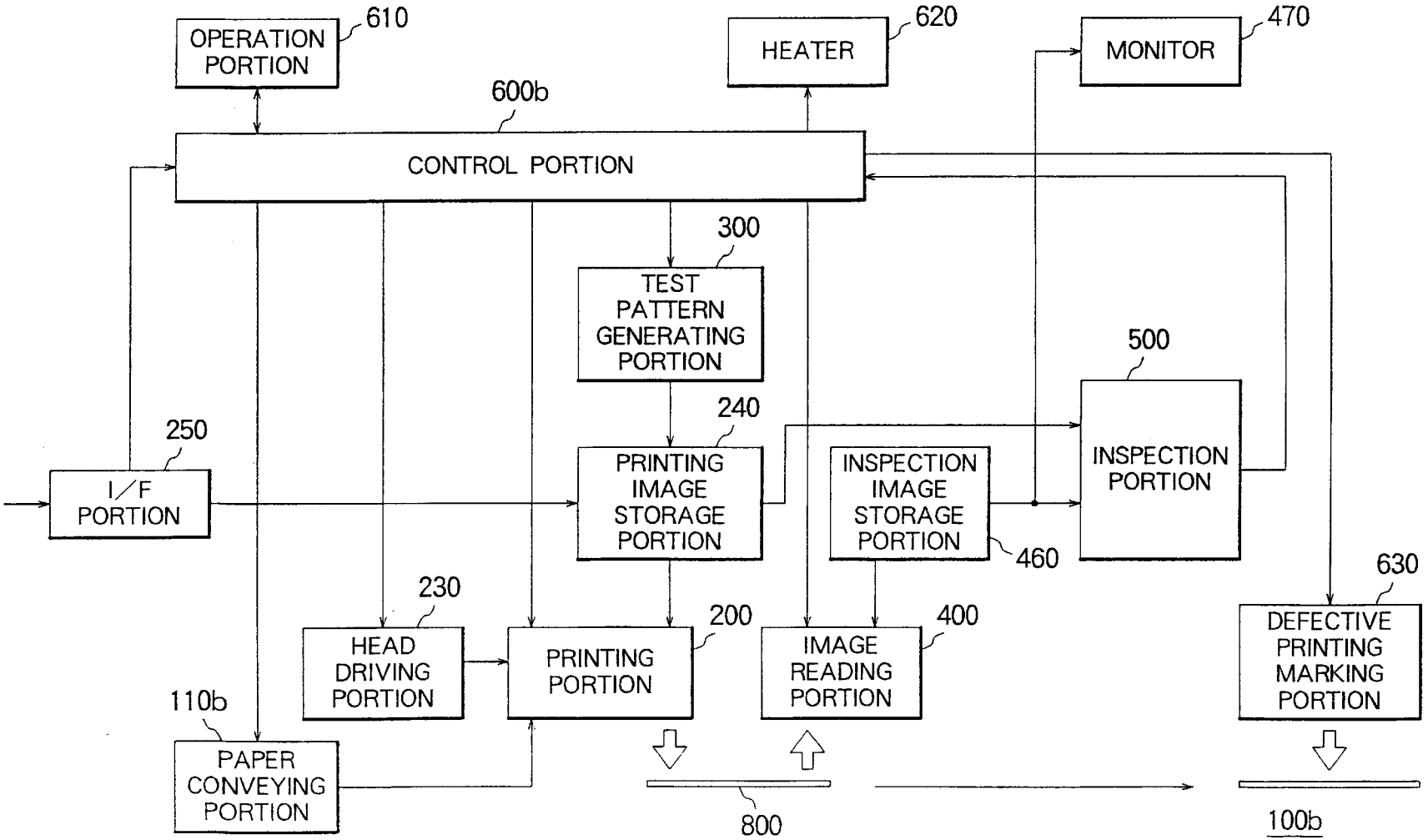
FIG. 15 is a view of the configuration of the printer apparatus.

FIG. 15 is a view of the configuration of the printer apparatus 100*b*.

As shown by the configuration shown in FIG. 15, the printer apparatus 100*b* of the second embodiment is different from the printer apparatus 100*a* of the first embodiment in the point that the defective printing marking portion 630 is newly provided and in the fine points of the operation of the paper conveying portion 110*b* and the control portion 600*b* accompanying this. The rest of the basic configuration is the same as that of the printer apparatus 100*a* of the first embodiment.

The defective printing marking portion 630 prints a mark that designates the printing content of printed matter invalid in the case of printed matter on which the desired image is printed by the printing portion 200 but which has been determined to be defective printed matter as a result of inspection of the result of the printing by the inspection portion 500.

The defective printing marking portion 630 has, as shown in FIG. 14A and FIG. 14B, a "paint-out" use printing head 631 serving as the first printing head, a defective printing mark printing head 632 serving as the second printing head, and a not illustrated printing control portion. The printing control portion controls the heads based on signals input from the control portion 600*b* to print the desired image at the desired position.

The paint-out use printing head 631 is a head for printing a predetermined paint-out pattern at a predetermined region of the printed matter. The content which has been already printed at that region is painted out by this so that it cannot be discriminated so as thereby to enable it to be seen at first glance that the printed matter is a sub-standard article and to prevent the printed matter from being used as actual printed matter. More specifically, where for example the object being printed is the bill addressed to a specific party, the part of the name and address is painted out so that the defectively-printed bill is not actually sent out. Where the object being printed is a negotiable security or monetary certificate, for example the part showing the value of the certificate or the number is painted out so that it may be seen at first glance that it is unusable.

The defective printing mark printing head 632 prints a predetermined mark at a predetermined region of defective printed matter which enables it to be seen that the printed matter is defective printed matter when the printed matter is passed through an inspecting apparatus or is viewed by a printing worker etc. In the present embodiment, an error code comprised of alphanumerics indicating the type of the detected defect is printed at the blank region at the bottom right of the printed matter.

These paint-out use printing head 631 and defective printing mark printing head 632 are ink jet heads which have the same configuration and printing system as those of the heads 220 of the printing portion 200. The printing width is one inch each. Further, these heads can be moved to any position in the main scanning direction (direction perpendicular to the paper feeding direction). Accordingly, by moving these heads to the region in which the paint-out pattern and defective printing mark should be printed in advance based on the paper to be printed and the printing format, these patterns can be printed at any position on the printing paper. Note that the correct printing position in the printing region of each head is controlled by the printing control portion in the defective printing marking portion 630.

Further, the printing control portion detects the position of the printed matter based on the output of a not illustrated encoder provided at the marking portion paper conveyance unit $\mathbf{110}_{-5}$ of the paper conveying portion 110*b* mentioned later and determines the correct printing position of the sub-scanning direction (paper feeding direction).

The paper conveying portion 110*b* is newly provided with a marking portion paper conveyance unit $\mathbf{110}_{-5}$ for conveying the printing paper in the defective printing marking portion 630. It is therefore comprised by the hopper unit $\mathbf{110}_{-1}$, printing portion paper conveyance unit $\mathbf{110}_{-2}$, inspection portion paper conveyance unit $\mathbf{110}_{-3}$, marking portion paper conveyance unit $\mathbf{110}_{-5}$, heater portion paper conveyance unit $\mathbf{110}_{-4}$, and stacker unit which are all integrally connected with each other and stably convey the printing paper at a high predetermined speed.

The control portion 600*b* controls the portions constituting the printer apparatus 100*b* in the same way as the control portion 600 of the first embodiment to make them perform the desired operations. Then, particularly, when a signal indicating a printing defect is input from the inspection portion 500 during the printing operation, the printing image data and printing position information are output and the defective printing marking portion 630 performs printing to make the printed matter invalid.

Next, an explanation will be made of the operation of the printer apparatus 100*b* referring to FIG. 16.

Figure 16:
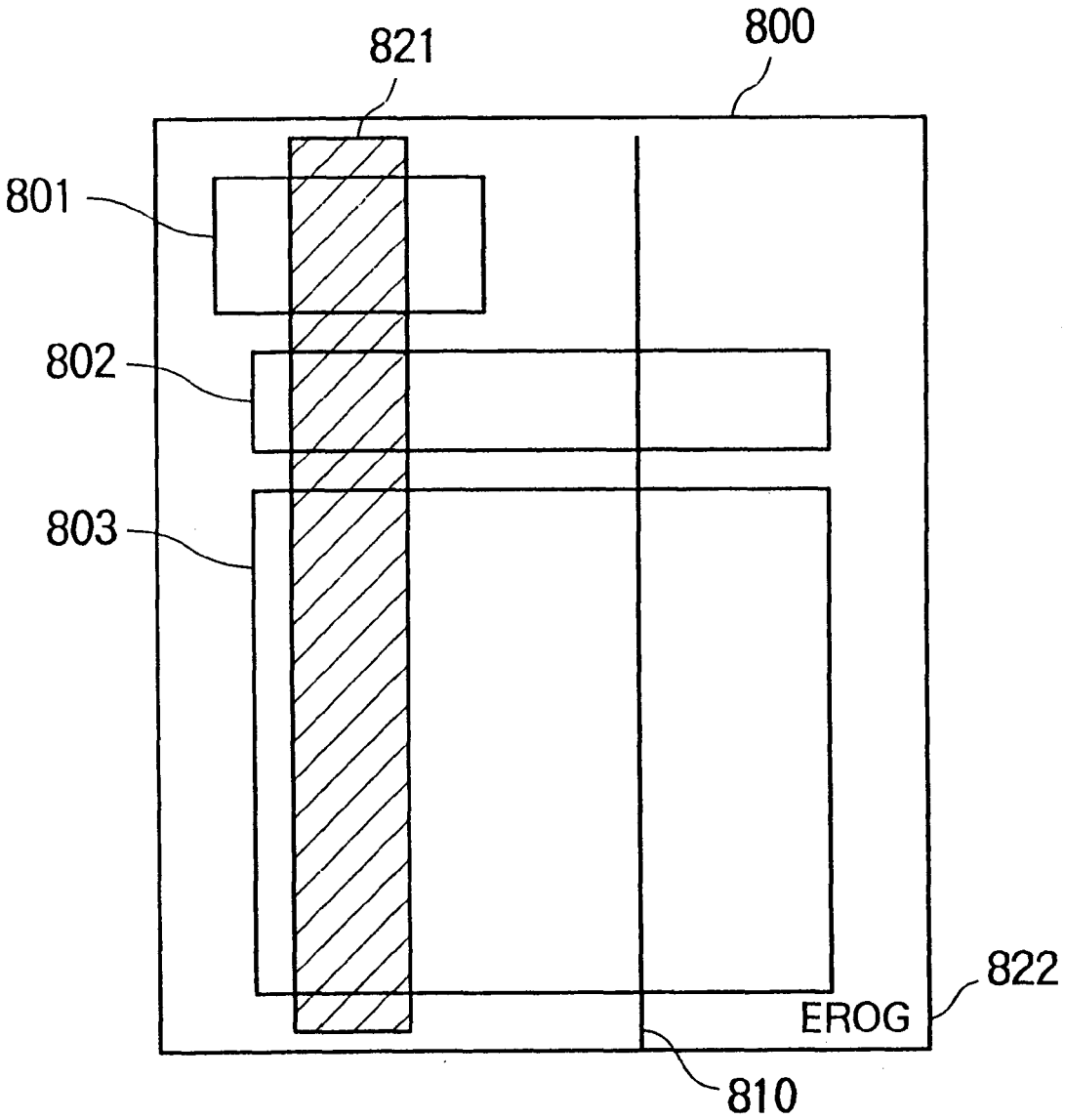
FIG. 16 is a view of the printed matter processed by the printer apparatus shown in FIG. 15.

FIG. 16 is a view explaining the printed matter processed by the printer apparatus 100*b*.

In the printed matter shown in FIG. 16, the content to be printed on the printing paper 800 by the printer apparatus 100*b* is a bill of for example a telephone charge which includes, as illustrated, the name and address 801 of the party billed, information 802 of the party billed, and details 803 of the bill.

Below, an explanation will be made of the operation of the printer apparatus 100*b* for the case where such a bill is to be printed by the printer apparatus 100*b*.

First, before the actual printing processing, test patterns generated by the test pattern generating portion 300 are used to perform an inspection of the state of printing, printing quality, etc. When confirming as the result of the inspection that the printer apparatus 100*b* normally operates, the printing content, the printing conditions, etc. are input via the operation portion 610 and the higher host computer. The portions of the printer apparatus 100*b* are initialized by the input information. At this time, for example, the type of the paint-out pattern printed by the defective printing marking portion 630, the paint-out region, the type of the defective printing mark, the printing position of the defective printing mark, etc. are also set.

When the initialization is ended, the bit map image data to be successively printed is input via the interface portion 250, stored in the printing image storage portion 240, and then printed on the printing paper 800 by the printing portion 200.

The image printed on the printing paper 800 is read by the image reading portion 400 and stored in the inspection image storage portion 460 and compared with the original image data stored in the printing image storage portion 240 at the inspection portion 500, where it is decided whether or not the two images coincide. Where the two images coincide, it is regarded that the printing was suitably carried out and the printed matter is successively stacked in a not illustrated stacker as it is.

If a black line 810 as shown in FIG. 16 was caused in the image printed by the printing portion 200 in the middle of such successive printing processing, the image which was read by the image reading portion 400 and stored in the inspection image storage portion 460 and the original image data stored in the printing image storage portion 240 will not coincide due to this black line 810. As a result, the inspection portion 500 detects that the state of printing is defective.

The inspection portion 500 inputs a signal indicating that the state of printing is defective to the control portion 600*b*. The control portion 600*b* then immediately outputs a signal to the defective printing marking portion 630 for making it paint out the predetermined region of the bill and print an error code indicating the detected defective state.

As a result, the paint out use printing head 631 paints out the region 821 black to make the content under this no longer visible. Further, the defective printing mark printing head 632 of the defective printing marking portion 630 records an error code 822 at the bottom right region of the printing paper.

Note that the bills on which these patterns and the error codes are printed are successively stacked in the stacker in the same way as the normally printed bills.

In this way, in the printer apparatus 100*b* of the second embodiment, when a printing defect occurs, the defective printed matter is processed so that the defective printed matter can be clearly identified and cannot be used as the actual printed matter. Accordingly, when desiring to select only the normally produced printed matter for use for its inherent purpose, even if defective printed matter were mixed in with the normal printed matter due to an error of the inspecting apparatus or worker, since the printed matter is printed by the printer apparatus 100*b*, the defective printed matter has been painted out black so that it can no longer be used for the original purpose and therefore accidents such as erroneous mailing of a bill can be almost completely prevented.

Further, even if defective printed matter is produced, the defective printed matter can be differentiated from the normal printed matter and the printing operation continued. Accordingly, loss due to a shutdown of the printer apparatus 100*b* can be reduced and the printing operation can be efficiently carried out.

Note that the invention is not limited to the above embodiment either. Various modifications are possible.

For example, the defective printing marking portion 630 does not have to be provided with both of the paint-out use printing head 631 and defective printing mark printing head 632 and may have only one of them.

Figure 17A:
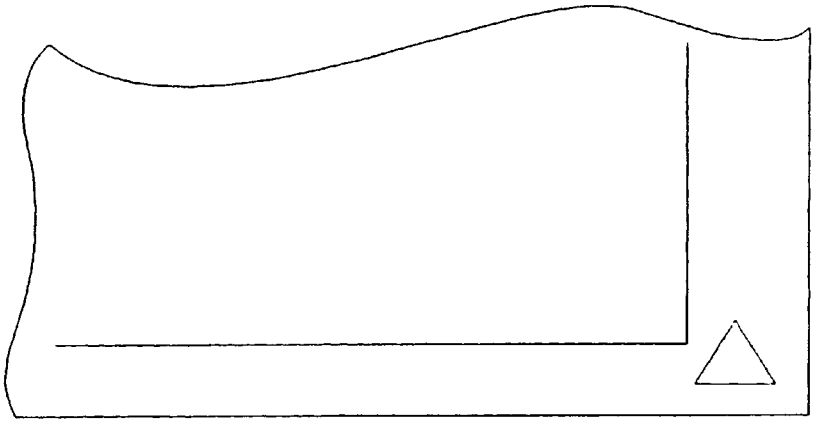
FIG. 17A is a view of a modification of an error code printed by a defective printing marking portion shown in FIG. 15 which shows that the printed matter is defective printed matter by a graphic mark.
Figure 17B:
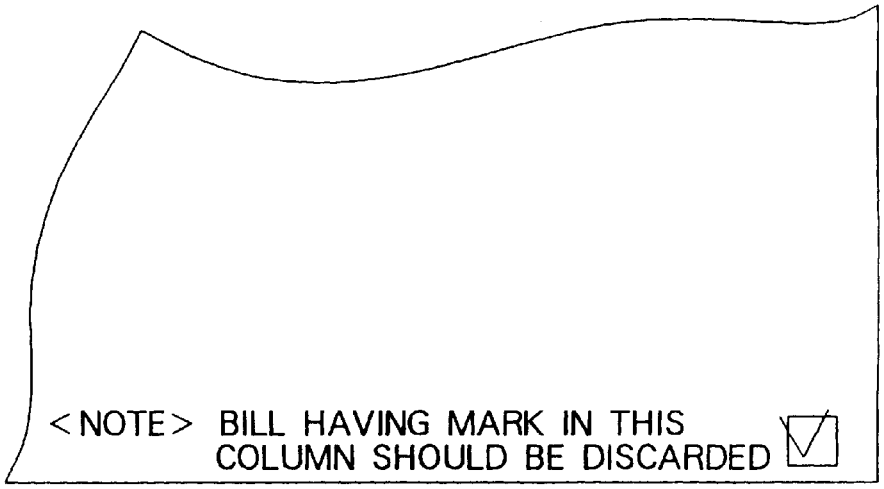
FIG. 17B is a view of a modification of an error code printed by the defective printing marking portion shown in FIG. 15 which shows that the printed matter is defective printed matter by making a note portion valid.

Further, the mark indicating a printing defect printed by the defective printing mark printing head 632 is not limited to the error code as shown in FIG. 16. For example, it is also possible to use a graphic to clearly indicate that the printed matter is defective printed matter as shown in FIG. 17A or possible to mark explanatory print indicating that the printed matter is not valid to indicate whether or not the explanatory print is valid as shown in FIG. 17B. In addition to this, a bar code etc. can also be used.

Further, the paint-out use printing head 631 and the defective printing mark printing head 632 of the defective printing marking portion 630 are not limited to the heads of an ink jet system. Heads of any system can be adopted.

Third Embodiment

A third embodiment of the present invention will be explained next referring to FIG. 18 to FIG. 26.

The apparatus explained as the third embodiment, in the same way as in the first embodiment and the second embodiment, is also a large scale printing system which prints the input printing data at a high speed by using a plurality of ink jet heads and inspects the result of the printing so that defective printed matter can be detected. However, the method of inspection thereof particularly differs from that of the first embodiment and the second embodiment in the point that the nonprinted regions, that is, the blank regions, are inspected based on the format information of the image data etc. to detect defects such as dripping of ink. This is the characteristic feature of the third embodiment.

In the third embodiment, the explanation will be made of the case where the present invention is applied to a printer apparatus for printing on the two sides of continuous form paper.

Note that the same symbols or numerals are given to the same components as those of the first embodiment and the second embodiment and explanations thereof will be omitted.

Figure 18A:
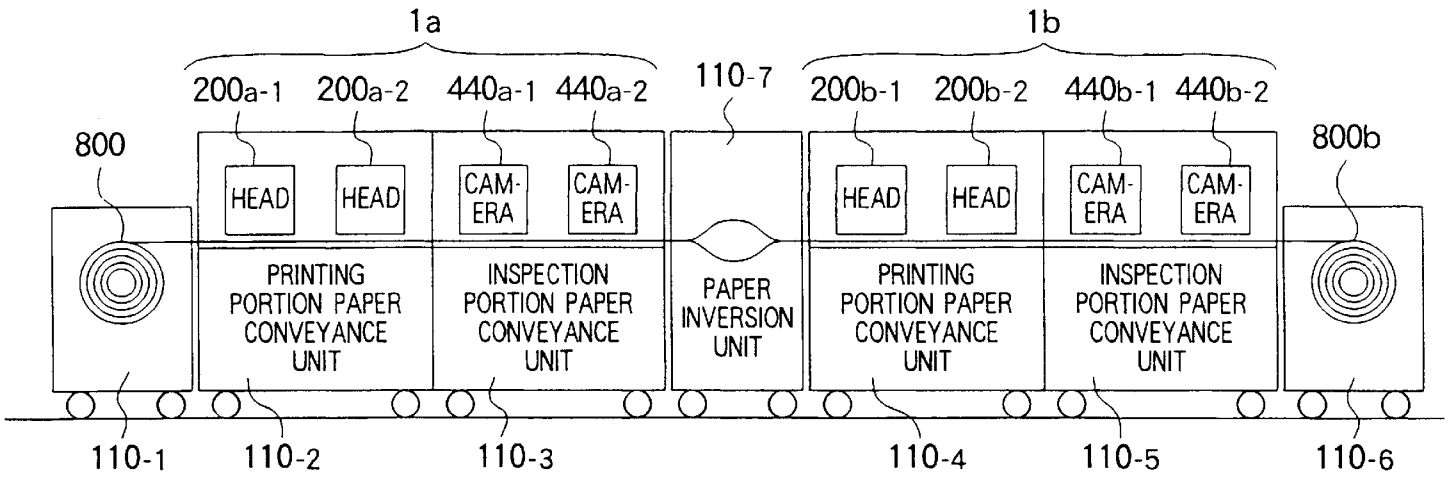
FIG. 18A and FIG. 18B are views of the outer appearance of the printer apparatus according to a third embodiment of the present invention.
Figure 18B:
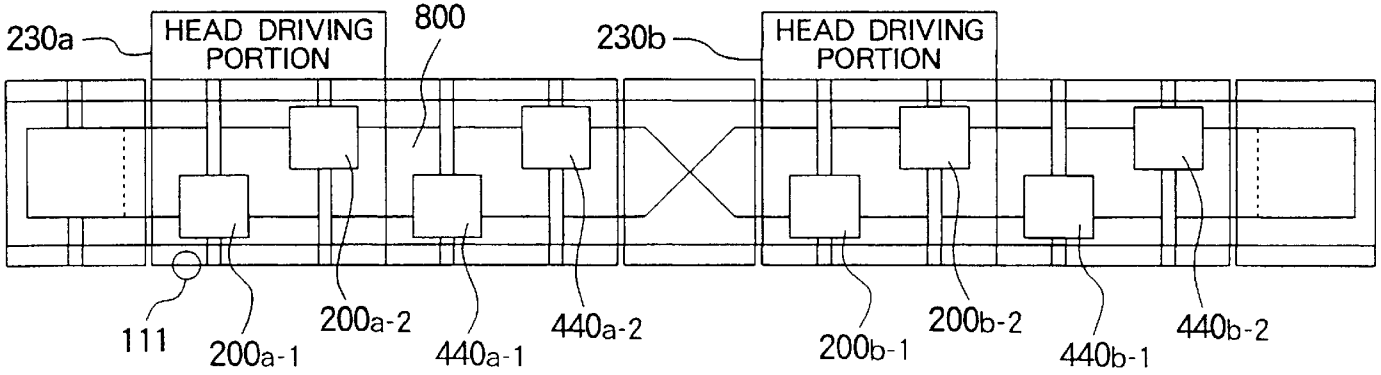

FIG. 18A and FIG. 18B are views of the outer appearance of the main components of the printer apparatus 100*c*, in which FIG. 18A is a side view and FIG. 18B is a top view.

As shown in FIG. 18A and FIG. 18B, the printer apparatus 1 has a front printer portion 1*a*, a back printer portion 1*b*, and a paper conveying portion 110. Further, the paper conveying portion 110 is constituted by a roll paper supplying portion $\mathbf{110}_{-1}$, a front printing portion paper conveyance unit $\mathbf{110}_{-2}$, and a front inspection portion paper conveyance unit $\mathbf{110}_{-3}$ contained in the front printer portion 1*a*, a paper inversion unit $\mathbf{110}_{-7}$, a back printing portion paper conveyance unit $\mathbf{110}_{-4}$ and a back inspection portion paper conveyance unit $\mathbf{110}_{-5}$ contained in a back printer portion 1*b*, and a roll paper take-up portion $\mathbf{110}_{-6}$.

In a printer apparatus 100*c* having such a configuration, the continuous form paper 800 is supplied from the roll paper supplying portion $\mathbf{110}_{-1}$, printing is carried out on the front surface of the paper 800 by the front printer portion 1*a*, the paper 800 is inverted by the paper inversion unit $\mathbf{110}_{-7}$, printing is carried out on the back surface of the paper 800 by the back printer portion 1*b*, and the paper 800*b* which has been printed on both surfaces is taken up around the roll paper take-up portion $\mathbf{110}_{-6}$.

Below, an explanation will be made of the configuration of the portions of the printer apparatus 100*c*.

First, the paper conveying portion 110 is a paper feeding mechanism for stably conveying the printing paper 800, that is, the medium to be printed, at a high predetermined speed.

The printer apparatus 100*c* of the third embodiment performs two-sided printing on the printing paper 800, i.e., the continuous form paper taken up in the form of a roll. Accordingly, the paper conveying portion 110 is constituted by the roll paper supplying portion $\mathbf{110}_{-1}$ for supplying the roll paper, a printing head $\mathbf{220}a_{-1}$ of the front printer portion 1*a*, the front printing portion paper conveyance unit $\mathbf{110}_{-2}$ for conveying the printing paper beneath the printing heads $\mathbf{220}a_{-1}$ and $\mathbf{220}a_{-2}$ of the front printer portion 1*a*, the front inspection portion paper conveyance unit $\mathbf{110}_{-3}$ for conveying the printing paper beneath the CCD cameras $\mathbf{440}a_{-1}$ and $\mathbf{440}a_{-2}$ of the front printer portion 1*a*, the paper inversion unit $\mathbf{110}_{-7}$ for inverting the printing paper 800 to the front and back, the back printing portion paper conveyance unit $\mathbf{110}_{-4}$ for conveying the printing paper beneath the printing heads $\mathbf{220}b_{-1}$ and $\mathbf{220}b_{-2}$ of the back printer portion 1*b*, the back inspection portion paper conveyance unit $\mathbf{110}_{-5}$ for conveying the printing paper beneath the CCD cameras $\mathbf{440}b_{-1}$ and $\mathbf{440}b_{-2}$ of the back printer portion 1*b*, and the roll paper take-up portion $\mathbf{110}_{-6}$ for successively taking up the ejected printing paper.

Each unit is constituted by a roller and guide for feeding the printing paper, and an encoder for detecting the rotation speed of the roller, etc. and performing the conveyance, stoppage, and speed adjustment of the printing paper based on control signals input from the not illustrated control portion.

Further, as shown in FIG. 18B, an encoder 111 is provided in the paper feed roller near the start of the front printing portion paper conveyance unit $\mathbf{110}_{-2}$. The pulse from this encoder 111 is used in the portions of the printer apparatus 100*c* as the signal for establishing the timing in the printing operation.

The printing paper 800 supplied from the roll paper supplying portion $\mathbf{110}_{-1}$ is printed with a cue mark by a not illustrated cue mark printing portion immediately after it is supplied to the printing portion 200. Thereafter, the heads and cameras mentioned later detect this cue mark by cue mark detection sensors provided in their vicinity and thereby can position the printing paper 800 in the sub-scanning direction.

The front printer portion 1*a* and the back printer portion 1*b* perform the printing on the front surface and back surface of the printing paper 800. Note that the front printer portion 1*a* and the back printer portion 1*b* have the same configuration, so an explanation will be made of only the configuration of the front printer portion 1*a* here.

Figure 19:
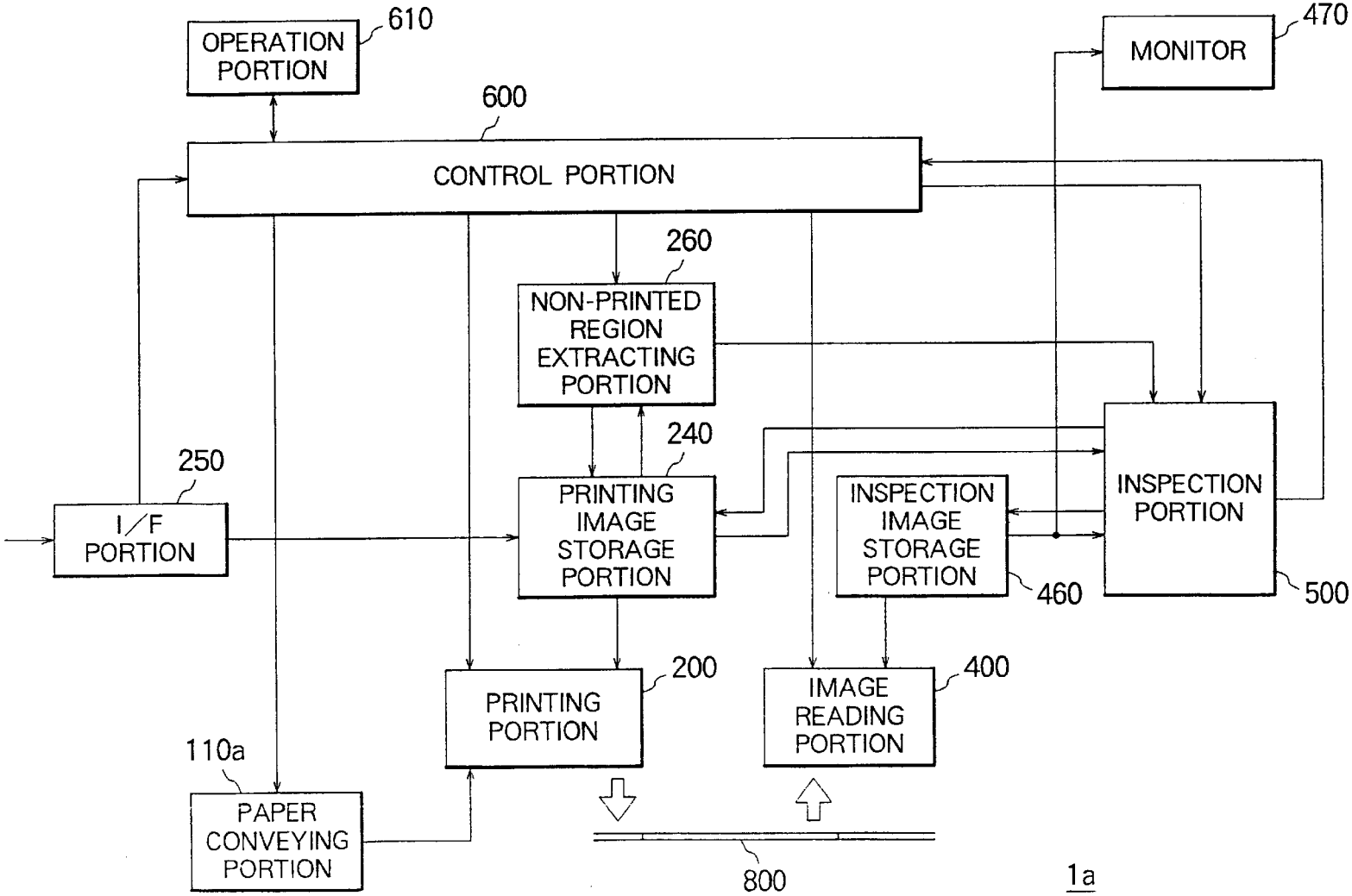
FIG. 19 is a view of the configuration of a front printer portion of the printer apparatus.

FIG. 19 is a block diagram of the configuration of the front printer portion 1*a*.

The front printer portion 1*a* has a paper conveying portion 110*a*, printing portion 200, printing image storage portion 240, interface portion 250, non-printed region extracting portion 260, image reading portion 400, inspection image storage portion 460, monitor 470, inspection portion 500, control portion 600, and operation portion 610.

The paper conveying portion 110*a* is comprised of the front printing portion paper conveyance unit $\mathbf{110}_{-2}$ and the front inspection portion paper conveyance unit $\mathbf{110}_{-3}$ of the paper conveying portion 110 mentioned before.

The printing portion 200 prints the image data stored in the printing image storage portion 240 on the printing paper based on a control signal input from the control portion 600.

An explanation will be made next of the printing portion 200 referring to FIG. 20 and FIG. 21A.

Figure 20:
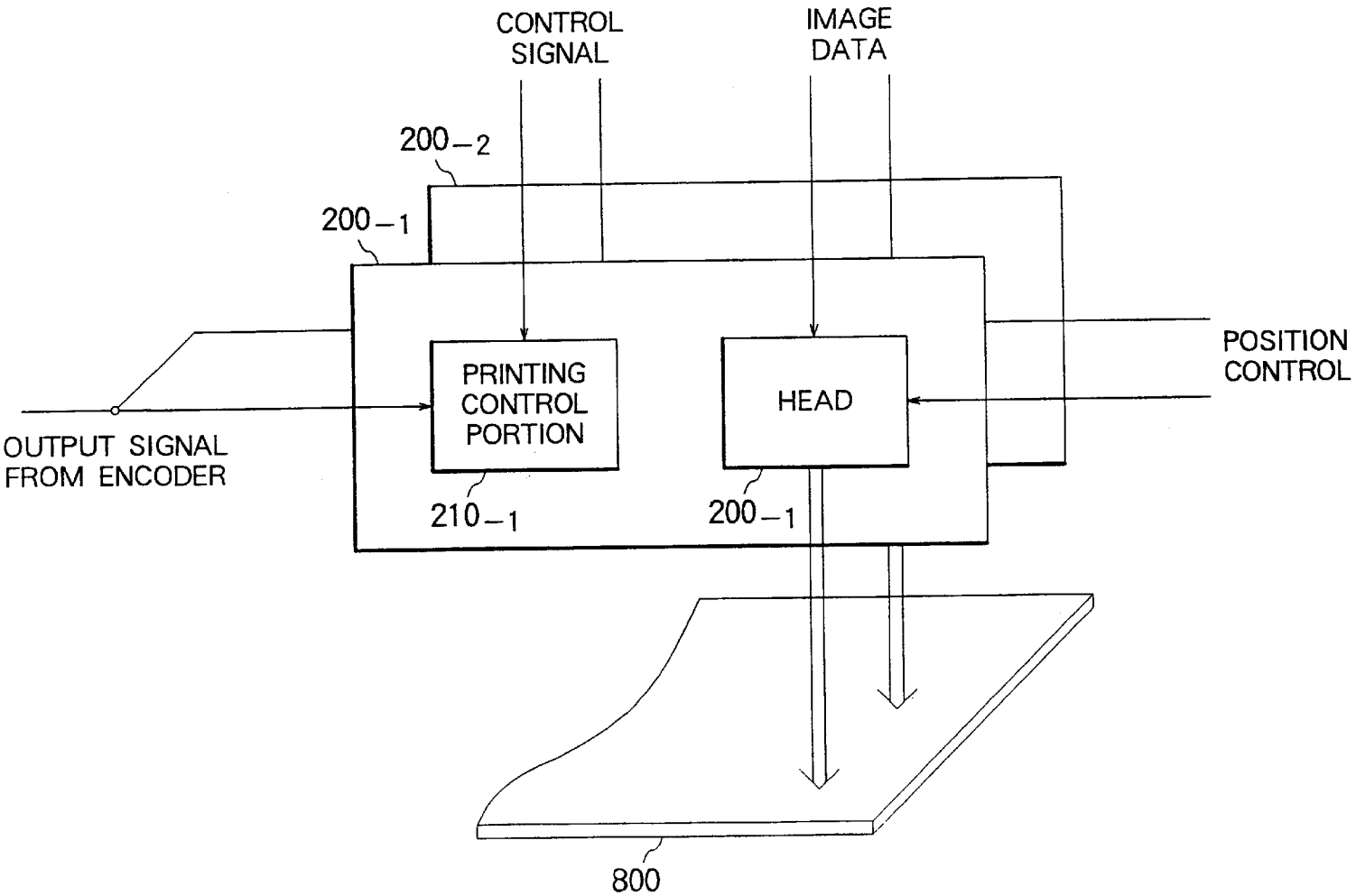
FIG. 20 is a view of the configuration of the printing portion of the front printer portion shown in FIG. 19.

FIG. 20 is a block diagram of the configuration of the printing portion 200.

The printing portion 200 is comprised of two printing portions $\mathbf{200}_{-1}$ and $\mathbf{200}_{-2}$. A control signal is input to each printing portion $\mathbf{200}_{-i}$ (i=1, 2) from the control portion 600 to read the image data stored in the printing image storage portion 240. Further, a signal from the encoder 111 of the paper conveying portion 110*a* mentioned before is commonly input to all printing portions $\mathbf{200}_{-1}$ and $\mathbf{200}_{-2}$.

Each printing portion $\mathbf{200}_{-i}$ (i=1, 2) has the printing control portion $\mathbf{210}_{-1}$ and the head $\mathbf{220}_{-i}$.

The printing control portion 210 controls the operational timing of the heads 220 with respect to the conveyed printing paper and the ink dropping speed mentioned later in the heads 220 based on control signals input from the control portion 600 and the signal input from the encoder 111 of the paper conveying portion 110*a*.

The heads 220 are ink jet heads each having a dot density of 240 dpi and a printing width Wh of 4 inches and successively record the image data read from the printing image storage portion 240 under the control of the printing control portion 210.

Figure 21A:
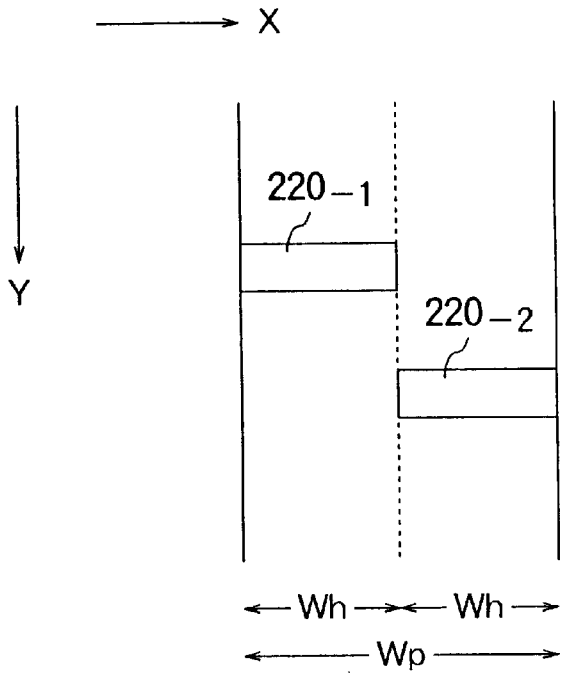
FIG. 21A is a view of the state of arrangement of the printing heads of the front printer portion shown in FIG. 19.

An arrangement of two heads $\mathbf{220}_{-1}$ and $\mathbf{220}_{-2}$ is shown in FIG. 21A.

As shown in FIG. 21A, the two heads $\mathbf{220}_{-1}$ and $\mathbf{220}_{-2}$ are arranged so that the printed dots of the heads run into each other. The printing can be carried out on printing paper with a printing width Wp of 8 inches (4 inches×2) as a whole.

The printing system of the heads 220 is the same as that of the first embodiment.

The printing image storage portion 240 has the same configuration as that of the first embodiment. In particular, any position can be accessed from the non-printed region extracting portion 260.

The interface portion 250, in the same way as the first embodiment and the second embodiment, is an interface which transfers the image data to the printing image storage portion 240.

The non-printed region extracting portion 260 extracts the non-printed regions on the printing paper 800 based on the image data stored in the printing image storage portion 240. A "non-printed region" means a region for which image data of a bit map format is not stored in the printing image storage portion 240 among all regions of the printing paper 800. The printing image storage portion 240 stores the image data of the substantially valid regions for every page of the printing paper 800 as for example a series of bit map data or as a plurality of series of bit map data divided into optional regions. In other words, there are regions of the printing paper 800 which are not covered by the bit map data stored in the printing image storage portion 240. For example, these are the regions on the periphery of each page, the regions of the spaces between the divided regions, etc. Further, if the recording medium is a continuous form paper, there is a certain wide non-printed region between the pages. The non-printed region extracting portion 260 extracts these non-printed regions.

The image reading portion 400 reads the image on the printing paper printed by the printing portion 200 and outputs the same as the bit map image data to the inspection image storage portion 460 so as to check the printing content and printing quality.

An explanation will be made next of the image reading portion 400 referring to FIG. 21B and FIG. 22.

Figure 21B:
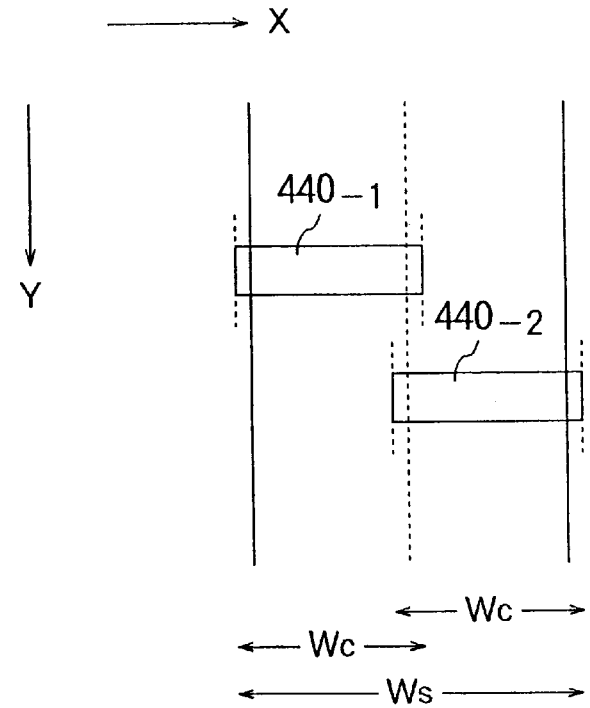
FIG. 21B is a view of the state of arrangement of the CCD cameras of the front printer portion shown in FIG. 19.
Figure 22:
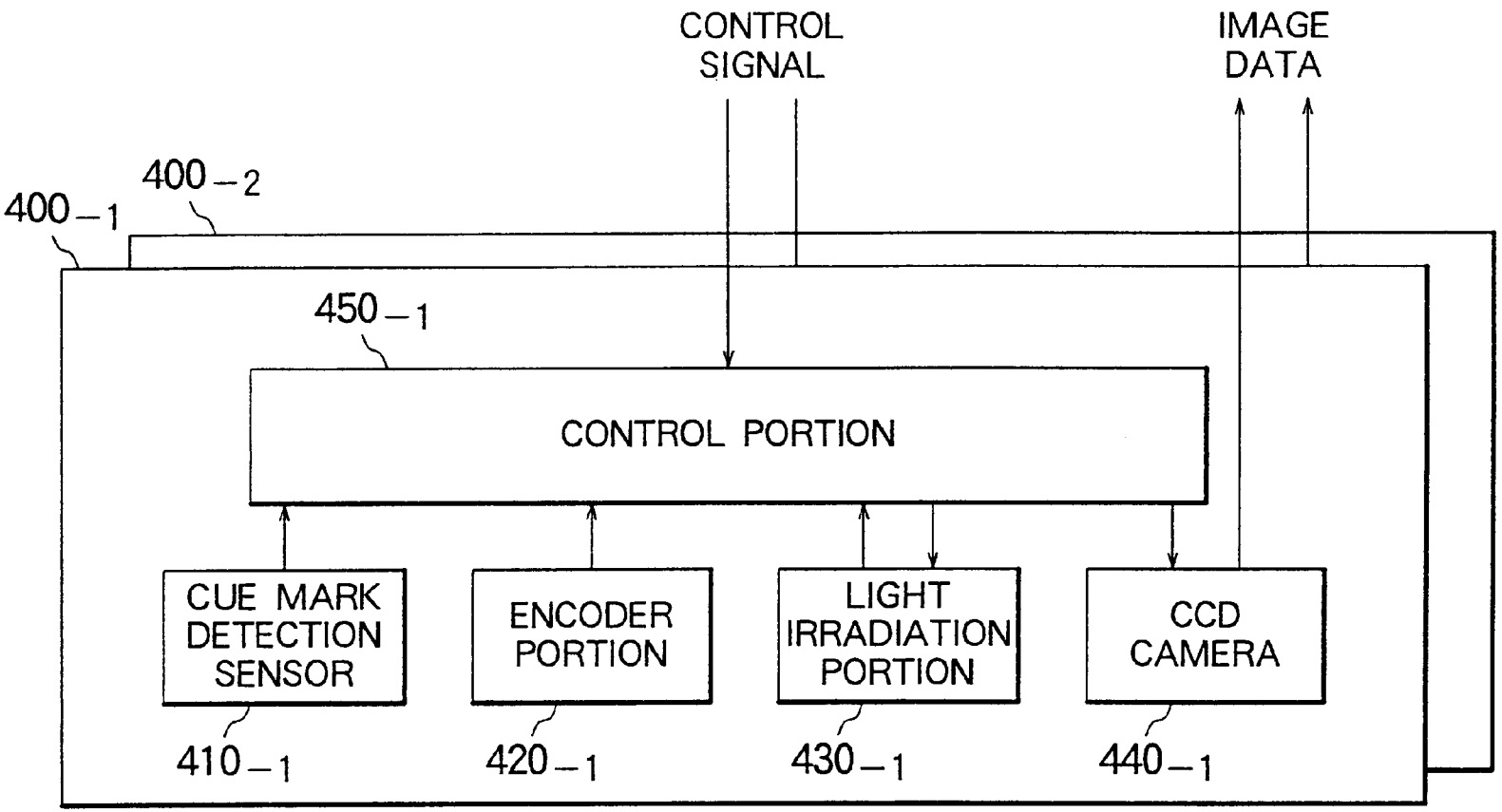
FIG. 22 is a view of the configuration of the image reading portion of the front printer portion shown in FIG. 19.

FIG. 21B is a view of the arrangement of the cameras $\mathbf{440}_{-1}$ and $\mathbf{440}_{-2}$ of the image reading portion 400; and FIG. 22 is a view of the configuration of the image reading portion 400.

The image reading portion 400 of the printer apparatus 100*c* of the third embodiment is constituted by two image reading portions $\mathbf{400}_{-1}$ and $\mathbf{400}_{-2}$ as shown in FIG. 22. The entire range of the printing width Wp of the head 220 can be read by arranging the two CCD cameras $\mathbf{440}_{-1}$ and $\mathbf{440}_{-2}$ as shown in FIG. 21B.

The configuration of each of the image reading portions $\mathbf{400}_{-i}$ (i=1, 2) is basically the same as the case of the first embodiment mentioned above, but the paper to be printed by the printer apparatus 100*c* of the third embodiment is continuous form paper, so a cue mark detection sensor $\mathbf{410}_{-i}$ is provided in place of the edge detection sensor of the first embodiment.

This cue mark detection sensor 410 is provided in the vicinity of the CCD camera 440 of each image reading portion 400 and detects the cue mark recorded at every break of the printed matter of the continuously conveyed printing paper 800. When sensor 410 detects a cue mark, the sensor 410 outputs a signal indicating the detected cue mark to the control portion 450.

The rest of the portions operate based on this signal in the same way as in the first embodiment, whereby the image on the printing paper can be suitably read.

The inspection image storage portion 460 is a storage means for storing the image data read by the image reading portion 400 and is constituted by two page memories $\mathbf{460}_{-1}$ and $\mathbf{460}_{-2}$ corresponding to the two CCD cameras $\mathbf{440}_{-1}$ and $\mathbf{440}_{-2}$.

The monitor 470 is a display device which displays the image data read by the two CCD cameras $\mathbf{440}_{-1}$ and $\mathbf{440}_{-2}$ as it is.

The inspection portion 500 decides whether or not the state of printing is adequate based on the inspection image data read from the printed matter stored in the inspection image storage portion 460 and outputs the result of its decision to the control portion 600. The inspection portion 500 successively carries out three types of inspections, i.e., the inspection of the non-printed regions, the inspection by the format information, and the inspection by matching with the original image data, to decide whether or not the state of printing is adequate.

Figure 23:
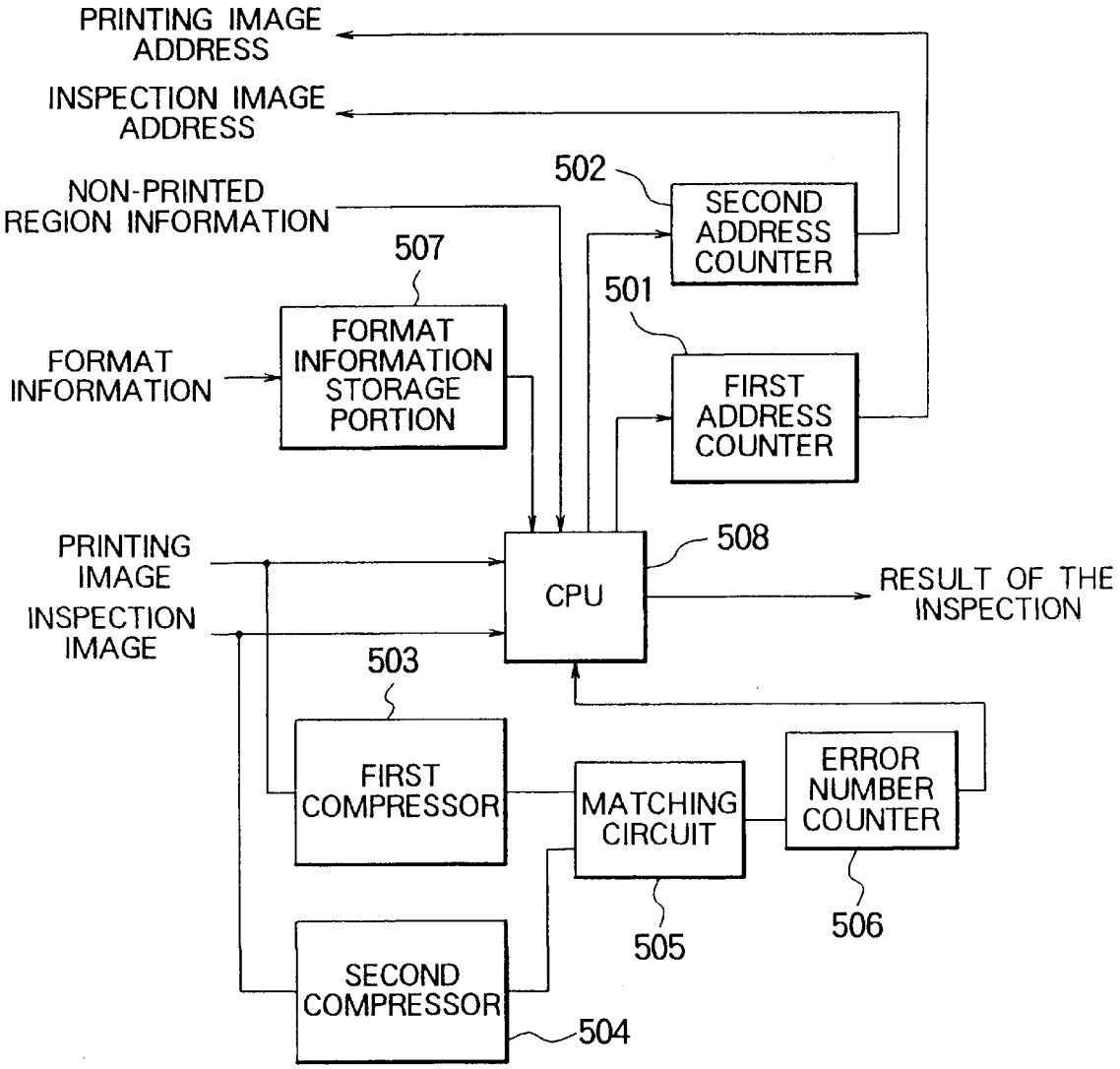
FIG. 23 is a view of the configuration of the inspecting portion of the front printer portion shown in FIG. 19.

An explanation will be made next of the configuration and operation of the inspection portion 500 referring to FIG. 23.

The inspection portion 500 has a first address counter 501, a second address counter 502, a first compressor 503, a second compressor 504, a matching circuit 505, an error number counter 506, a format information storage portion 507, and a CPU 508.

The first address counter 501 is a counter which controls the address of the printing image data stored in the printing image storage portion 240 to be read out to the inspection portion 500. Further, the second address counter 502 is a counter which controls the address of the inspection image data stored in the inspection image storage portion 460 to be read out to the inspection portion 500. The image data of the addresses designated by these address counters 501 and 502 are read out from the printing image storage portion 240 and the inspection image storage portion 460 and input to the inspection portion 500. Note that these address counters 501 and 502 are controlled by the initial settings input from the CPU 508 and the count up/down and other signals.

The first compressor 503 and the second compressor 504 compress the printing image data read from the printing image storage portion 240 and the inspection image data read from the inspection image storage portion 460, respectively, when performing the matching of the image data by the compressed image data. In this compression, for example, processing is performed to divided the image into blocks of 2×2 or 3×3 pixels and changing the compressed pixel to "1" when the total value of the pixels of the block is more than a predetermined value. This enables the original image to be compressed to ¼ or ⅑. Further, where the matching is carried out by using the original image data without performing compression, the first compressor 503 and the second compressor 504 output the respectively input image data as they are.

Note that whether the first compressor 503 and the second compressor 504 are to be made valid and the matching is to be carried out by a compressed image or whether the matching is to be carried out by the image of the original magnification, the compression rate in the case where the matching is to be carried out by a compressed image, etc. are set by input by not illustrated control signals from the outside via the control portion 600.

The matching circuit 505 successively compares the corresponding pixels of the printing image data input from the first compressor 503 and the inspection image data input from the second compressor 504 and outputs the result thereof to the error number counter 506. This comparison is carried out by calculating the difference of the pixel values of the corresponding pixels. Then, when the difference value is less than a predetermined value, the matching circuit 505 deems that the two pixels coincide. When the difference value is more than the predetermined value, it decides these pixels are different.

The error number counter 506 cumulatively adds the number of pixels determined to be different as a result of the matching carried out in the matching circuit 505 and outputs the cumulative result to the CPU 508 as the number of error pixels.

The format information storage portion 507 stores the common format information of the printing image data input via the control portion 600. The "common format information" means the data of for example the printing region of the name and address information, the position of the front, the position of the mark, the position of the letters, the position of the ruled lines, etc. The information stored in the format information storage portion 507 is read by the CPU 508 and used for checking the read image data stored in the inspection image storage portion 460.

The CPU 508 controls the portions of the inspection portion 500 to perform the inspection of the non-printed regions, the inspection based on the format information, and the inspection by the matching with the original image data mentioned above.

The CPU 508 first controls the second address counter 502 based on the non-printed region information which is extracted and input at the non-printed region extracting portion 260 and successively accesses in the sub-scanning direction the non-printed regions of the inspection image data stored in the inspection image storage portion 460. Then, the CPU 508 inspects whether or not there is a more than a predetermined length of continuous black pixels in the non-printed region. Where the result of the inspection is that there are such continuous black pixels, it decides that a black streaker was caused and outputs a result of inspection indicating that the printing result was defective to the control portion 600.

Further, the CPU 508 inspects the image data stored in the inspection image storage portion 460 by structural analysis techniques based on the format information stored in the format information storage portion 507.

The check of the inspection image data by this structural analysis technique is processing for checking whether or not the printing image data has been suitably printed by extracting the structural characteristics of the printing image data based on the format information of the printing image data stored in the format information storage portion 507 and checking whether or not also the inspection image data has exhibited similar characteristics.

For example, the CPU 508 obtains information on the position of a blank region having a certain area in the printing image data from the information stored in the format information storage portion 507 and checks whether or not the corresponding position of the inspection image data stored in the inspection image storage portion 460 similarly is a blank region. When that region is a suitable blank region, the operation shifts to the next check. Where black pixels more than the level of noise are detected from a region, the CPU 508 ends the check and outputs a result of inspection indicating that the printing result was defective to the control portion 600.

Further, the CPU 508 obtains ruled line information stored in for example the format information storage portion 507, finds the black pixel histogram in the vertical direction or the horizontal direction of the corresponding region from the inspection image data stored in the inspection image storage portion 460, and checks whether or not a ruled line exists at that position.

Further, by scanning a region in which letters are printed in the direction of the train of letters, there is a frequent change of the black pixels and the white pixels. It is possible to therefore detect that letters are printed there. This method is used to check if letters are printed in the regions in which letters are supposed to be printed.

In addition to this, the CPU 508 checks if the front is suitably at the position where the front should be or if the mark suitably exists.

At the time of the inspection by this structural analysis, if a contradiction is detected, the CPU 508 immediately outputs a result of inspection indicating that the printing result was defective to the control portion 600 and then ends the processing.

Further, the CPU 508 controls the first address counter 501, the second address counter 502, and the first compressor 503 to the error number counter 506 to perform the processing for the matching of the original image data stored in the printing image storage portion 240 and the inspection image data stored in the inspection image storage portion 460.

Then, the CPU 508 compares the number of error pixels input from the error number counter 506 with the threshold value THL. If the number of the error pixels is larger than the threshold value THL, the CPU 508 decides that the printing was defective, while if the matching ended without the threshold value THL being exceeded, it decides that the printing was normal.

Note that, before performing these inspections, the CPU 508 positions the printing image data and the inspection image data. This positioning is processing for detecting the corresponding positions of the image data on the image memories of the printing image storage portion 240 and the inspection image storage portion 460. For example, the CPU 508 performs processing for establishing correspondence by using the pixels of the top sides at which the cue marks of the two image data were detected as a reference, detecting the center of the black pixels of the two images and determining the corresponding pixels by using that point as a reference, etc.

By such an operation of the CPU 508, the inspection portion 500 inspects the printing image data stored in the inspection image storage portion 460.

The control portion 600 controls the portions constituting the printer apparatus 100*c* to make them to perform the desired operations.

The control portion 600 receives as input the printing conditions and control conditions from the higher host computer via the Ethernet I/F in the control portion 600. The control portion 600 sets the operating conditions of the paper conveying portion 110*a*, printing portion 200, image reading portion 400, etc. so that the conveyance of the printing paper, the printing to the printing paper, and the reading of the printed image can be suitably carried out in synchronization.

Further, the control portion 600 controls the paper conveying portion 110*a* and the printing portion 200 etc. so as to immediately stop the printing operation when a signal indicating a printing defect is input from the inspection portion 500 during the printing operation.

The operation portion 610 is an operation terminal for performing relatively easy operations such as the setting of the operating conditions and printing parameters for the printer apparatus 100*a* or informing the worker of data received from the printer apparatus 100*a*. In the present embodiment, use is made of a general purpose PC which is connected by an RS232C interface.

To the operation portion 610 is further output a log file of the results of inspection of the state of printing etc.

Next, an explanation will be made of the operation of the printer apparatus 100*c* by referring to FIG. 24.

Figure 24:
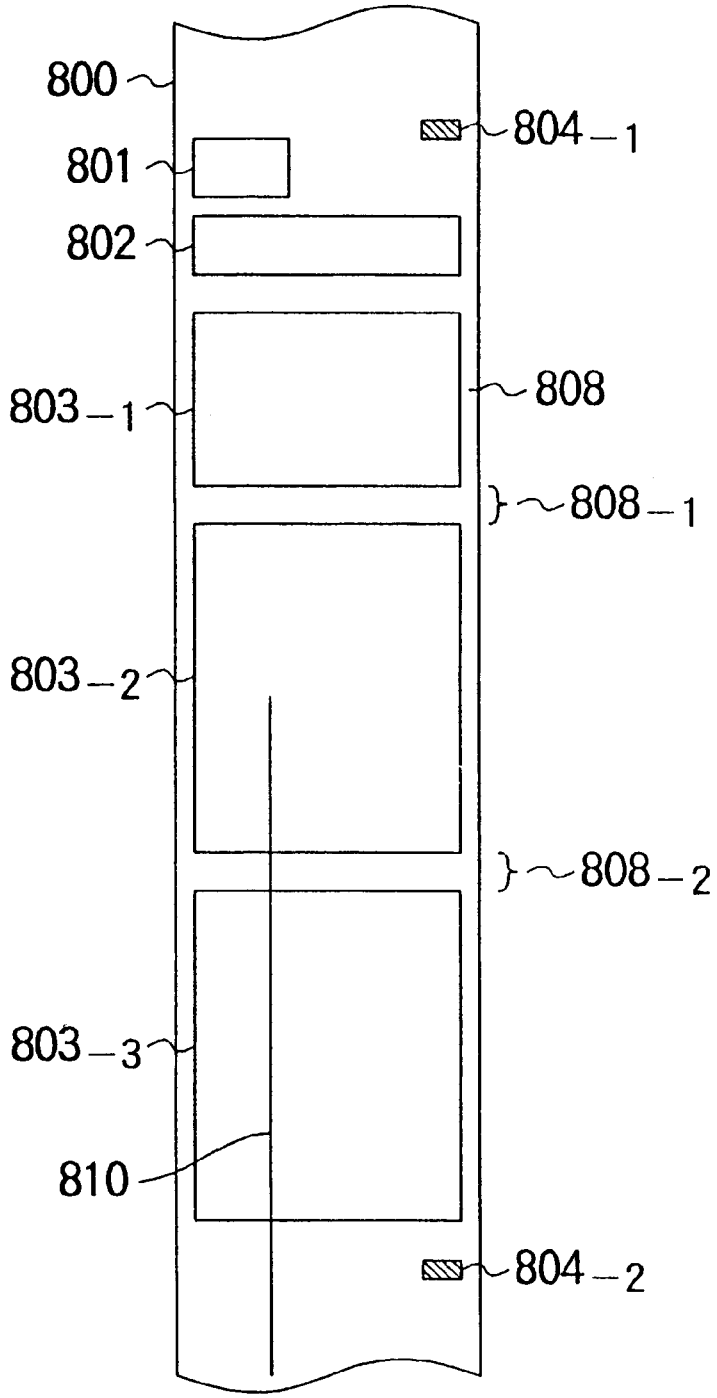
FIG. 24 is a view of the image data printed on printing paper of continuous form paper by the printer apparatus shown in FIG. 18A and FIG. 18B.

FIG. 24 is a view of the state where the image data is printed by the printer apparatus 100*c* on printing paper 800 comprised of continuous form paper.

The printed object shown in FIG. 24 is for example the bill of a telephone charge. The printing paper 800 is for example printed with the name and address 801 of the party to be billed, information 802 of the party to be billed, and details $\mathbf{803}_{-1}$ to $\mathbf{803}_{-3}$ of the bill. Further, a cue mark 804 is printed at the top right of the first page of each bill. This cue mark enables determination of where each bill breaks on the continuous form paper.

Note that FIG. 24 is a view of the state of printing of one surface of the printing paper 800, but similar printing is carried out also on the back surface.

Below, an explanation will be made of the operation of the printer apparatus 100*c* for the case where such a bill is printed by the printer apparatus 100*c*.

First, the printing content, printing conditions, etc. for the printer apparatus 100*c* are input via the operation portion 610 or the higher host computer. By this, a not illustrated control portion sets the operating conditions of the front printer portion 1*a*, the back printer portion 1*b*, the paper conveying portion 110, etc.

When the conditions finish being set, it becomes possible to start the actual printing operation. The printing paper 800 is successively supplied from the roll paper supplying portion $\mathbf{110}_{-1}$ to the front printer portion 1*a*. Along with this, the printing bit map image data is successively input to the front printer portion 1*a* via the interface portion 250 and stored in the printing image storage portion 240. The image data stored in the printing image storage portion 240 is read out by the printing portion 200 and printed on the supplied printing paper 800. As a result, bills having the names and addresses 801 of parties to be billed, information 802 of the parties to be billed, and details $\mathbf{803}_{-1}$ to $\mathbf{803}_{-3}$ of the bills are successively printed.

Further, at this time, the non-printed region extracting portion 260 reads the image data stored in the printing image storage portion 240 and detects the non-printed regions which are not covered by the bit map data in the regions on the printing paper 800. Due to this, in the example shown in FIG. 24, for example, the non-printed region 808 containing the blank $\mathbf{808}_{-1}$ between the first page and the second page, the blank $\mathbf{808}_{-2}$ between the second page and the third page, etc. is extracted.

The image printed on the printing paper 800 is read by the image reading portion 400 and stored in the inspection image storage portion 460. The image data stored in the inspection image storage portion 460 is successively output to the monitor 470 simultaneously with being supplied for the inspection of the state of printing in the inspection portion 500.

The inspection portion 500 first examines whether or not a black streaker exists in the region corresponding to the non-printed region 808 detected by the non-printed region extracting portion 260 on the printing paper 800. Specifically, the region corresponding to the non-printed region of the inspection image data stored in the inspection image storage portion 460 is successively scanned in the sub-scanning direction of the printing paper 800. When more than the predetermined threshold value of black pixels continue in that region, it is decided that a black streaker exists and that the printing head is abnormal. Note that this threshold value is determined in consideration with the magnitude of the noise which can occur etc. When it is decided that a black streaker exists, a signal indicating that the state of printing is not adequate is immediately output to the control portion 600, and the control portion 600 immediately stops the printing processing.

In the example shown in FIG. 24, a black streaker 810 occurred in the middle and bottom of the second page. In such a case, this black streaker 810 is detected when the blank $\mathbf{808}_{-2}$ between the second page and the third page is scanned, a signal indicating that the state of printing is not adequate is output to the control portion 600, and the printing processing is ended.

When there is no black streaker in the non-printed region, in the next part of the inspection, it is examined whether or not the inspection image data stored in the inspection image storage portion 460 has structural characteristics not contradictory with the format information stored in the format information storage portion 507, that is, whether or not the predetermined blank regions, train of letters, ruled lines, etc. suitably exist as mentioned above. When it is decided at the time of this inspection that the characteristics of the inspection image data are not suitable, a signal indicating that the state of printing was not suitable is immediately output to the control portion 600, and the control portion 600 immediately stops the printing processing.

Then, as the final part of the inspection, matching is performed between the printing image data stored in the printing image storage portion 240 and the inspection image data stored in the inspection image storage portion 460. The two images are successively compared as compressed images or original images. If there are more than a predetermined number of different pixels, it is decided that the two images do not coincide, that is, the state of printing was not suitable for certain reasons, and a signal indicating this fact is input to the control portion 600. The control portion 600, in the same way as at the time of the other parts of the inspection heretofore, then commands suspension of the processing to the paper conveying portion 110 and the printing portion 200, and the printing operation is immediately suspended.

Where these three parts of the inspections are all successfully passed, it is determined that the printing was suitably carried out and the printing is continued.

The printing paper 800 which passes the front printer portion 1*a* and which is printed on the front surface with the desired image data is inverted from front to back at the paper inversion unit $\mathbf{110}_{-7}$ and supplied to the back printer portion 1*b*.

The back printer portion 1*b* prints the desired image data on the back surface of the printing paper 800 and performs the inspection by the same operation as that of the front printer portion 1*a*. Where it is decided that the printing is not suitably carried out as a result, the printing operation is immediately suspended.

Then, the printing paper 800 printed on the front and back surfaces is successively taken up around the roll paper take-up portion $\mathbf{110}_{-6}$.

In this way, the printer apparatus 100*c* of the third embodiment regards a blank region which is not covered by the printing image data as a non-printed region and scans this region in the sub-scanning direction to detect black streakers. Accordingly, it is possible to detect black streakers by easy processing at the start and to find abnormalities of the printing heads and therefore possible to quickly detect defective printing. Particularly, such a black streaker is frequently caused in an ink jet system printer apparatus like the printer apparatus 100*c*, therefore this method is effective for a printer apparatus of such a printing system.

Further, since the non-printed region is extracted by the non-printed region extracting portion based on the input image data, the control with respect to the printer apparatus 100*c* will not become complex and the scanning will not become complex, therefore the printer apparatus can be used with the same operability as that of conventional printer apparatuses.

Further, in the printer apparatus 100*c*, after the inspection based on the non-printed regions, the structural characteristics are further extracted based on the format information of the printing image data and used for inspection of the state of printing. By this, for example, streakers generated in the printing region, white blanks, etc. are effectively detected and it is possible to effectively inspect the state of printing.

Further, the printer apparatus 100*c*, after the inspection based on the structural characteristics, performs template matching between the printing image data and the inspection image data to inspect the state of printing. By this, even fine differences such as differences of the printing content are stored and extracted making it possible to perform the inspection of the state of printing more effectively and correctly.

Since the printer apparatus 100*c* performs three steps of inspection with respect to individual printed matter in this way, it becomes possible to inspect the state of printing from various perspectives and possible to suitably detect and eliminate defective printed matter and ship out only correct and high quality printed matter.

Further, since the printer apparatus 100*c* immediately suspends the operation of the printer apparatus 100*c* where a defective printing is found, the generation of the defective printed matter can be suppressed to the lowest level and waste of time, printing resources, etc. can be reduced as much as possible.

Note that the present invention is not limited to the present embodiment either. Various modifications are possible.

For example, the inspection portion 500 of the present embodiment checked the state of printing by performing the three steps of inspections of the first inspection using the information of the non-printed region, the second inspection using the format information, and the third inspection by matching. However, any combination of these inspections is possible. It is also possible to omit the second inspection and third inspection or perform a new inspection based on experience with the reliability of the printing heads, actually occurring problems, etc. Further, it is also possible to use any information and method for the format information and the method of matching.

Further, in the first inspection method based on the information of the non-printed region performed in the inspection portion 500, in the present embodiment, the image data was scanned in the sub-scanning direction of the printing paper 800 to determine the continuity of the black pixels. This method is very effective for the detection of the black streakers which frequently occur with heads of the ink jet system, but the invention is not limited to this method. For example, it is also possible to perform similar detection of the streakers in the main scanning direction or scan in any direction to extract the blocks of more than a predetermined number of continuous black pixels. By this, it becomes possible to detect even dripping droplets of ink falling in a broken line and thereby possible to detect a broader range of abnormalities of the printing heads.

Figure 25:
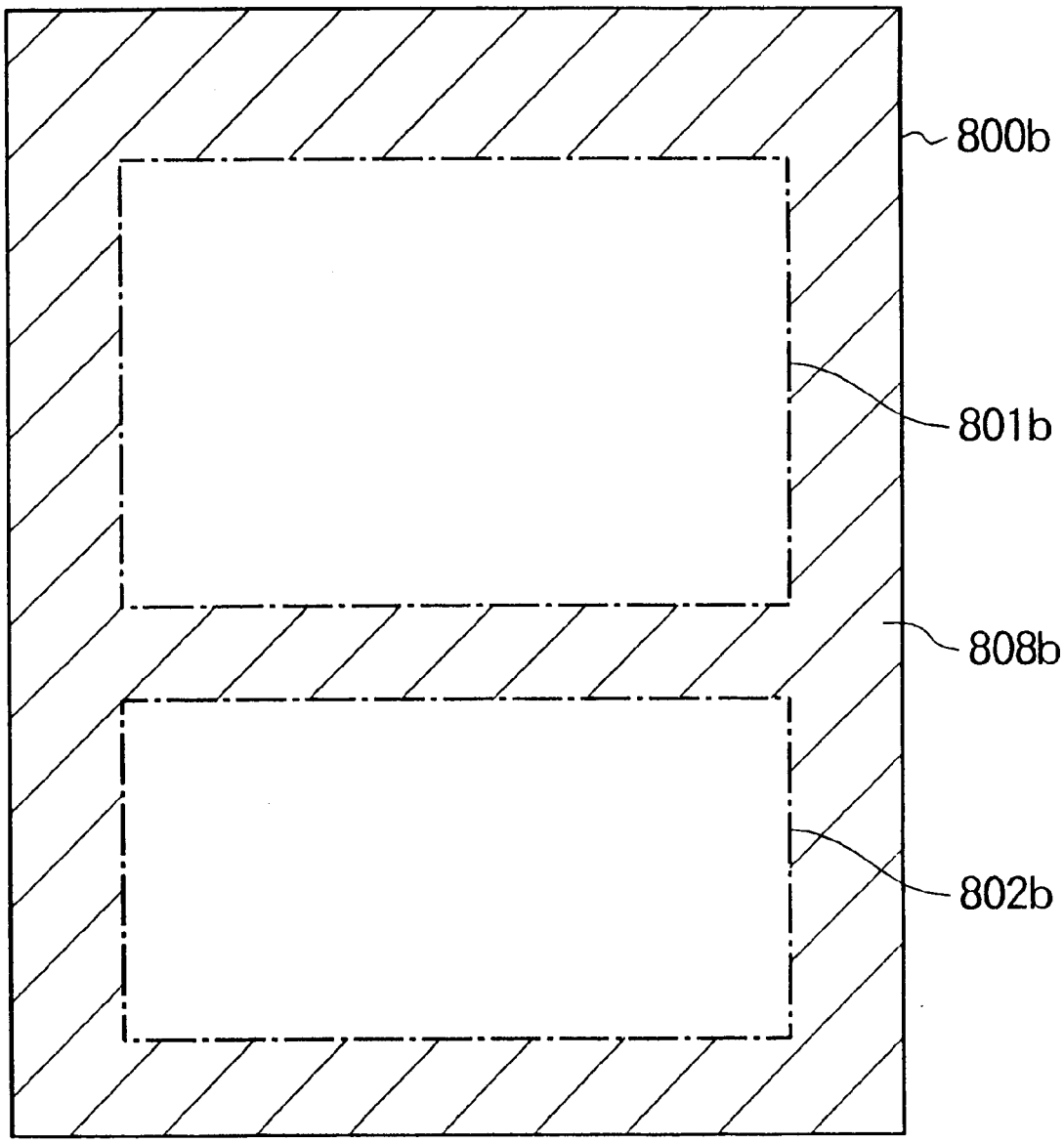
FIG. 25 is a view of the image data printed on printing paper by the printer apparatus shown in FIG. 18A and FIG. 18B.

Further, the inspection of the non-printed region of the present embodiment can be applied also to an apparatus performing printing with respect to cut paper. When the print medium is cut paper as shown in FIG. 25, the extraction of the non-printed region is carried out similar to the time of the continuous form paper in the non-printed region extracting portion 260 and the blank region 808*b* in the cut paper 800*b* other than the printing image data 801*b* and 802*b* is detected as the non-printed region.

Further, the non-printed region extracting portion 260 of the present embodiment detected the region on the printing paper 800 stored in the printing image storage portion 240 and not covered by the bit map data and defined the same as the non-printed region. However, it is also possible to further analyze the contents of the bit map data, extract the blank region from among them, and extract that blank region as the non-printed region.

Figure 26:
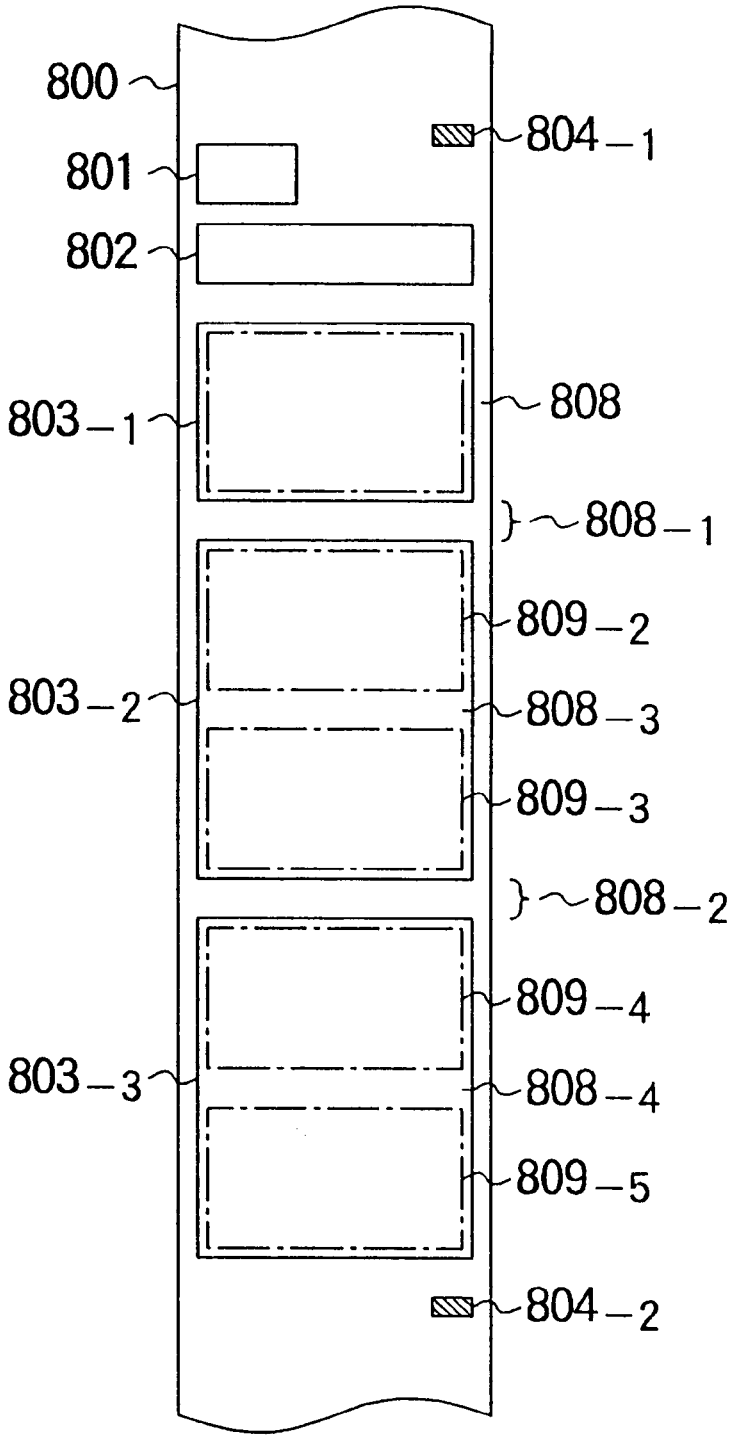
FIG. 26 is a view of a printing image showing a modification of the operation of a non-printing region extracting portion of the front printer portion shown in FIG. 19.

This will be concretely explained by referring to FIG. 26.

In FIG. 26, the printing image storage portion 240 stores the bit map data for the regions 801 to 803. In the above embodiments, the regions other than these regions were extracted as the non-printed regions 808. However, if further analyzing the contents of the bit map data, it is found for example that the region $\mathbf{803}_{-2}$ is comprised by a series of letter blocks $\mathbf{809}_{-2}$ and $\mathbf{809}_{-3}$. It is possible therefore to determine that the blank region $\mathbf{808}_{-3}$ exists between them.

Accordingly, in the non-printed region extracting portion 260, it is also possible to analyze the contents of the bit map data to extract the blank regions and to define them as the non-printed regions which can be referred to from the inspection portion 500. By adopting such a configuration, the detection of the black streakers can be carried out with a higher precision and the black streakers generated in the region covered by the image data can be quickly found.

Further, in the present embodiment, the printer apparatus 100*c* was immediately stopped when defective printing was detected, but it is also possible to suspend the operation of the printer apparatus 100*c* only when defective printing continuously occurs to a certain extent.

The black streakers which occur due to the ink jet heads etc. sometimes naturally disappear after a while. In a case where such a recovery of printing can be expected, if the processing until the restart is complex and takes a long time after the printer apparatus is once stopped, the printing operation can in some cases be more efficiently carried out by continuing the operation without stopping the apparatus even if a printing defect is detected. In such a case, a configuration can be adopted for continuously operating the printing apparatus as much as possible without immediately stopping the printer apparatus. The conditions of the suspension of operation of the printer apparatus 100*c* at that time can be freely determined.

Note that where the operation of such a printer apparatus is not immediately suspended, it is necessary to be able to easily find the printed matter determined to be defectively printed later so as to identify the defective printed matter or suitably eliminate the defective printed matter.

For this purpose, desirably for example the identification code and the bill number thereof are indicated on the monitor 470 etc.

Further, it is also possible to configure the apparatus to mark the printed matter determined to be defectively printed in some way or another as in the second embodiment.

Further, the printer apparatus 100*c* of the present embodiment was configured so the non-printed region extracting portion 260 extracted the non-printed regions by referring to the image data stored in the printing image storage portion 240, but it is also possible to input data indicating the non-printed regions from the outside, that is, a host computer or the like, together with the printing image data etc. When adopting such a configuration, a storage portion for storing the data indicating the input non-printed regions becomes necessary, but the non-printed region extracting portion 260 becomes unnecessary and therefore the configuration of the apparatus is simplified.

Other Modifications

The present invention is not limited to the first to third embodiments. Further modifications are possible.

For example, in the above embodiments, the present invention was applied to a printer apparatus, but it is also possible to apply the present invention to for example the inspecting apparatus of printed matter in already existing printers.

The configuration of such a printed matter inspecting apparatus corresponds the configuration of the printer apparatuses of the above embodiments without the printing portions. Namely, the print output data is input to the inspecting apparatus, and the image data obtained by scanning the printed matter is inspected based on the print output data.

Such an inspecting apparatus can be applied to various already existing printing apparatuses. An example of the application is shown in FIGS. 27A and 27B.

Figure 27A:
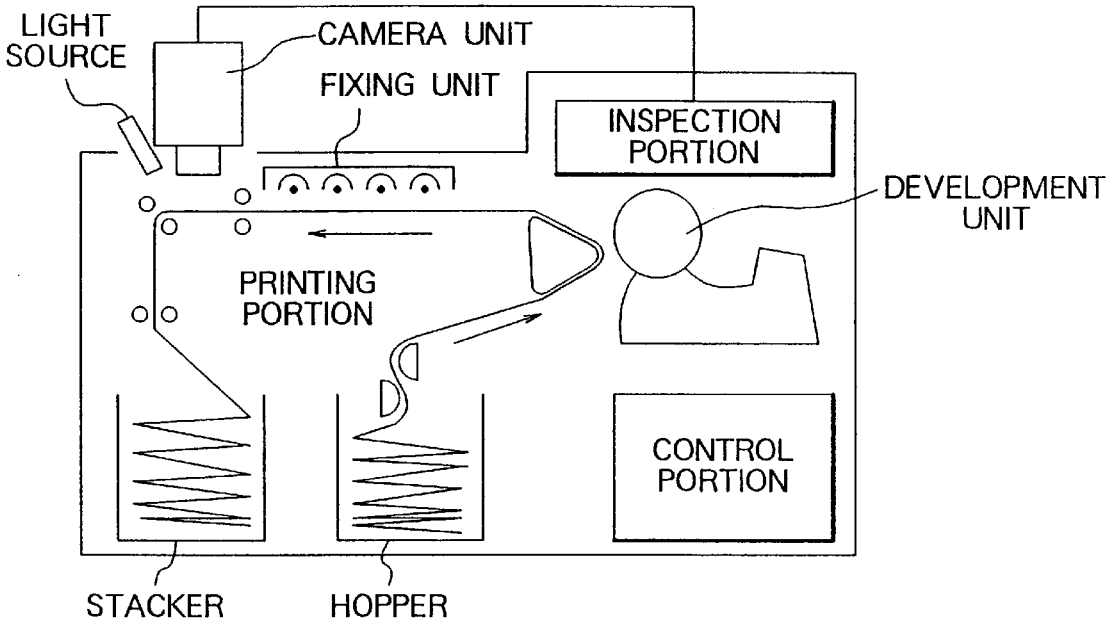
FIG. 27A and FIG. 27B are views of a case where the inspecting apparatus according to the present invention is applied to a printer apparatus of the electrophotographic system.
Figure 27B:
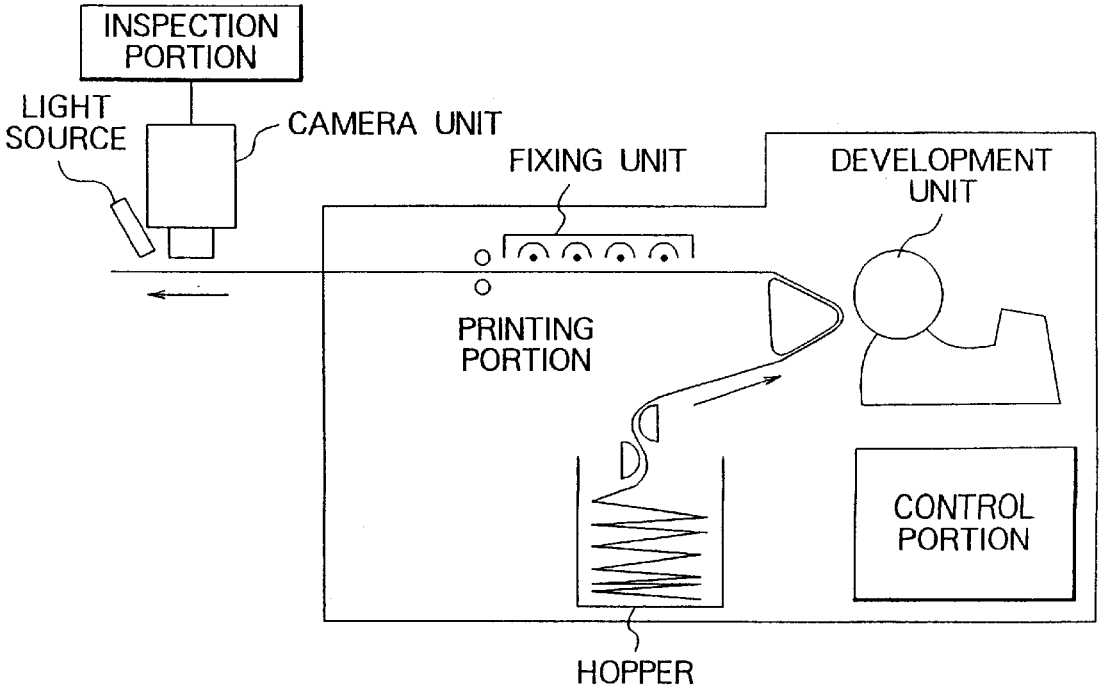

FIGS. 27A and 27B are views of the configuration when the printed matter inspecting apparatus according to the present invention is applied to a printer apparatus of the electrophotographic system (laser beam printer, LED printer, etc.) FIG. 27A is a view of a configuration in which the printed matter inspecting apparatus is built into the printer apparatus, while FIG. 27B is a view of the configuration in which the printed matter inspecting apparatus is provided outside of the printer apparatus and inspects the printed matter ejected from the printer apparatus.

In the printer apparatuses shown in FIGS. 27A and 27B, the printing width is about 17 inches, the printing speed is about 70 m/min, and the speed is sufficiently high. In the electrophotographic system, the printing is carried out over an entire printing region of 17 inches by one head, therefore one camera unit is sufficient in the sense of inspecting the head.

In such a printer apparatus of the electrophotographic system, after printing a large amount of data, the printing density becomes low or stains are caused in the background. By inspecting the printed matter which results from the printing, such defects can be quickly found and coped with. Note that, as specific inspection methods and configurations of the inspection portions shown in FIG. 27A and FIG. 27B, the methods and configurations shown in the first embodiment to third embodiment can be applied as they are.

In this way, according to the printer apparatus of the present invention, printing defects can be easily detected at a high speed with a high precision. Therefore, when a printing defect occurs, processing for example for suspending the operation printer apparatus immediately becomes possible. As a result, a printer apparatus can be provided having a high reliability with which normal printing can be efficiently carried out by preventing a drop in the efficiency caused by production of a large amount of defective printed matter etc. and with which correct and high quality printing can be carried out at a high speed.

What is claimed is:

1. A printer apparatus for successively printing input data, comprising:

an input means for inputting image data of each printing region of each print matter;

a first printing means for printing said input image data on a print medium;

an image sensing means for sensing the printed image on said print medium and reading the sensed printed image as image data;

an inspecting means for comparing said image data input at said input means and the image data read at said image sensing means corresponding to said input image data by a bit map manner and inspecting whether contents and a state of printing are adequate or inadequate every print matter; and a second printing means for printing a specific image indicating an invalid state when said inspecting means determines that at least one of the contents and the state of printing is inadequate.

2. The printer apparatus as set forth in claim 1, wherein said inspecting means performs template matching between bit map data of the image data of each printing region of each print matter and bit map data of the image data read by said image sensing means, detects a difference between the bit map data of the image data of each printing region of each print matter and the bit map data of the image data read by said image sensing means, and decides at least one of the contents and the state of said printing is inadequate when an amount of said difference is more than a predetermined standard value.

3. The printer apparatus as set forth in claim 1, wherein said image sensing means reads image data of a desired area including a non-printing region which is outside of said printing region from said print medium, and said inspecting means inspects the state of said printing based on the image data of the non-printing region of the print medium read by said image sensing means to decide whether the printing is adequate or inadequate.

4. The printer apparatus as set forth in claim 3, further comprising a non-printed region extracting means for extracting at least one of a blank region on said print medium and a blank region in the image data as said non-printed region based on input printing information.

5. The printer apparatus as set forth in claim 1, wherein said input means further inputs format information of each printing region of each print medium, further comprising a characteristic extracting means for extracting structural characteristics from said image data read by said image sensing means; and wherein said inspecting means inspects whether said extracted characteristics are adequate or inadequate by referring to said input format information to decide at least one of the contents and the state of said printing is inadequate when inadequate characteristics exist.

6. The printer apparatus as set forth in claim 1, wherein said first printing means suspends said printing when said inspecting means determines that the state of printing is inadequate.

7. The printer apparatus as set forth in claim 1, wherein said second printing means includes a defective printing marking portion having at least one of a paint-out use printing head and a defective printing mark printing head, said paint-out use printing head for printing the specific image by painting out an already printed region on said print medium so that said already printed region cannot be discriminated, and said defective printing mark printing head for printing the specific image as a predetermined mark at a predetermined region on said print medium for defect notification.

8. The printer apparatus as set forth in claim 1, further comprising:

a test pattern generating means for generating a predetermined test pattern, and wherein;

said first printing means prints said generated test pattern on the print medium when the printer apparatus is under test operation, said image sensing means reads image data of said printed test pattern on the print medium, and said inspecting means compares said generated test pattern and the read test pattern to inspect the state of printing by said first printing means.

9. The printer apparatus as set forth in claim 8, wherein;

said first printing means has a printing head in which a plurality of printing heads for printing dots at a predetermined pitch in predetermined printing regions are arranged so that the printing regions of the printing heads substantially continue with respect to a direction of a printing width which is perpendicular to a conveyance direction of the print medium, capable of performing the printing to the print medium with the printing width of the continuous printing regions formed by the plurality of printing heads by sub-scanning in a direction perpendicular to the direction of the printing width; and said inspecting means inspects continuity of printing results by said plurality of printing heads by said inspection, and further comprising a printing head moving means for moving said plurality of printing heads so that said continuity has a predetermined precision and for correcting a position thereof.

10. The printer apparatus as set forth in claim 9, wherein said plurality of printing heads are ink jet heads which print dots of the predetermined pitch on said print medium by jetting ink to the print medium from nozzles provided at the predetermined pitch.

11. A printed matter inspecting apparatus, comprising:

an image sensing means for sensing a print medium constituting a print matter and reading image data on the print medium;

an input means for inputting image data of each printing region of each print matter used to print the image to said print medium;

an inspecting means for comparing said input image data of each printing region of each print matter and the image data read from said print medium corresponding to said input image data and inspecting whether at least one of contents and a state of printing are adequate or inadequate every print matter; and a printing means for printing a specific image indicating an invalid state when said inspecting means determines that at least one of the contents and the state of printing is inadequate.

12. The printed matter inspecting apparatus as set forth in claim 11, wherein said inspecting means performs template matching between bit map data of the image data of each printing region of each print matter and the bit map data of the image data read by said image sensing means, detects a difference between the bit map data of the image data of each printing region of each print matter and the bit map data of the image data read by said image sensing means, and determines at least one of the contents and the state of the printing is inadequate when an amount of said difference is more than a predetermined standard value.

13. The printed matter inspecting apparatus as set forth in claim 11, wherein;

said image sensing means reads image data of a desired area including a non-printing region which is outside of said printing region from said print medium; and said inspecting means inspects the state of the printing based on the image data of the non-printing region of the print medium read by said image sensing means to decide whether the printing is adequate or inadequate.

14. The printed matter inspecting apparatus as set forth in claim 11, wherein said input means further inputs format information of each printing region of each print medium;

further comprising a characteristic extracting means for extracting structural characteristics from said image data read by said image sensing means; and wherein said inspecting means inspects whether said extracted characteristics are adequate or inadequate by referring to said input format information to decide at least one of the contents and the state of said printing is inadequate when inadequate characteristics exist.

15. The printer apparatus as set forth in claim 11, wherein said printing means includes a defective printing marking portion having at least one of a paint-out use printing head and a defective printing mark printing head, said paint-out use printing head for printing the specific image by painting out an already printed region on said print medium so that said already printed region cannot be discriminated, and said defective printing mark printing head for printing the specific image as a predetermined mark at a predetermined region on said print medium for defect notification.

16. A printer apparatus for successively printing input data, comprising:

input means for inputting image data of each printing region of each print matter;

printing means, having a printing head means in which a plurality of printing heads for printing dots at a predetermined pitch in predetermined printing regions are arranged so that the printing regions of the printing heads substantially continue with respect to a direction of a printing width which is perpendicular to a conveyance direction of the print medium, capable of performing the printing to the print medium with the printing width of the continuous printing regions formed by the plurality of printing heads by sub-scanning in a direction perpendicular to the direction of the printing width, for printing said input image data on a print medium;

image sensing means for sensing the printed image on said print medium and reading the sensed printed image as image data;

inspecting means for inspecting continuity of printing results by said plurality of printing heads based on the image data read by said image sensing means; and printing head moving means for moving said plurality of printing heads so that said continuity can be secured with a predetermined precision and for correcting a position of said plurality of printing heads.

17. The printer apparatus as set forth in claim 16, further comprising:

test pattern generating means for generating a predetermined test pattern, and wherein, said printing means prints said generated test pattern on the print medium when the printer apparatus is under test operation;

said image sensing means reads image data of said printed test pattern on the print medium; and said inspecting means compares said generated test pattern and the read test pattern to inspect the continuity of the printing results by said plurality of printing heads of said printing means.

* * * * *

UNITED STATES PATENT AND TRADEMARK OFFICE

CERTIFICATE OF CORRECTION

PATENT NO. : 6,106,094

DATED : August 22, 2000

INVENTOR(S) : Taizo Otani and Tsutomu Yoneda

It is certified that error appears in the above-identified patent and that said Letters Patent is hereby corrected as shown below:

On the cover page of the patent, first column, section [73], change "Nit" to --Ntt--.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*